US009034166B2

(12) United States Patent
Tatebe et al.

(10) Patent No.: US 9,034,166 B2
(45) Date of Patent: May 19, 2015

(54) ANODIZATION AND POLISH SURFACE TREATMENT

(75) Inventors: Masashige Tatebe, Hyogo (JP); Howard Bujtor, San Carlos, CA (US); Jody Akana, San Francisco, CA (US); Jonathan P. Ive, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 74 days.

(21) Appl. No.: 12/876,032

(22) Filed: Sep. 3, 2010

(65) Prior Publication Data

US 2011/0214993 A1 Sep. 8, 2011

Related U.S. Application Data

(63) Continuation-in-part of application No. 12/554,596, filed on Sep. 4, 2009.

(51) Int. Cl.

| | |
|---|---|
| ***C25D 11/02*** | (2006.01) |
| ***C25D 5/00*** | (2006.01) |
| ***C25D 5/34*** | (2006.01) |
| ***C25D 5/48*** | (2006.01) |
| ***C25D 7/00*** | (2006.01) |

(52) U.S. Cl.

CPC .. *C25D 5/00* (2013.01); *C25D 5/34* (2013.01); *C25D 5/48* (2013.01); *C25D 7/00* (2013.01); *C25D 11/02* (2013.01)

(58) Field of Classification Search

CPC ..... C25D 11/02
USPC ..... 205/214, 324
See application file for complete search history.

(56) References Cited

U.S. PATENT DOCUMENTS

| | | | | |
|---|---|---|---|---|
| 2,990,300 | A | | 6/1961 | Paskell |
| 3,016,293 | A | | 1/1962 | Cybriwsky et al. |
| 3,187,428 | A | * | 6/1965 | English ..... 205/207 |
| 3,709,742 | A | | 1/1973 | Jacobs |
| 3,886,052 | A | | 5/1975 | Smith |
| 4,093,754 | A | | 6/1978 | Parsons |
| 4,148,204 | A | | 4/1979 | Dotzer et al. |
| 4,173,477 | A | * | 11/1979 | Shiba et al. ..... 430/264 |
| 4,272,342 | A | * | 6/1981 | Oda et al. ..... 205/659 |
| 4,444,628 | A | | 4/1984 | Furukawa et al. |
| 4,801,490 | A | | 1/1989 | Schuette |

(Continued)

FOREIGN PATENT DOCUMENTS

| | | |
|---|---|---|
| CN | 1368620 | 9/2002 |
| EP | 0 928 837 A2 | 7/1999 |

(Continued)

OTHER PUBLICATIONS

English Abstract of JP56-101896A.*

(Continued)

*Primary Examiner* — Bryan D. Ripa
(74) *Attorney, Agent, or Firm* — Downey Brand LLP

(57) ABSTRACT

A metal surface treated to have a distinct cosmetic appearance such as an integral layer that is glossy may be used in electronic devices. The surface treatment may include polishing a metal surface, texturing the polished metal surface, polishing the textured surface, followed by anodizing the surface, and then polishing the anodized surface. The metal surface may also be dyed to impart a rich color to the surface.

21 Claims, 25 Drawing Sheets

(56) References Cited

U.S. PATENT DOCUMENTS

| | | | | |
|---|---|---|---|---|
| 5,000,780 | A * | 3/1991 | Tokunaga | 75/246 |
| 5,062,021 | A | 10/1991 | Ranjan et al. | |
| 5,240,590 | A | 8/1993 | Brar et al. | |
| 5,593,528 | A | 1/1997 | Dings et al. | |
| 5,723,221 | A * | 3/1998 | Brooker et al. | 428/469 |
| 6,322,689 | B1 | 11/2001 | Omasa | |
| 6,588,085 | B2 | 7/2003 | Holloway | |
| 6,649,039 | B2 | 11/2003 | Hsu et al. | |
| 6,866,561 | B2 | 3/2005 | Andrews | |
| 7,931,939 | B2 | 4/2011 | Yamaguci | |
| 2003/0194572 | A1 | 10/2003 | Cooper et al. | |
| 2004/0118813 | A1 | 6/2004 | Lai | |
| 2004/0258857 | A1 | 12/2004 | Dagan et al. | |
| 2006/0032760 | A1 * | 2/2006 | Nishino et al. | 205/324 |
| 2006/0060472 | A1 | 3/2006 | Tomita et al. | |
| 2006/0169592 | A1 | 8/2006 | Mardilovich et al. | |
| 2008/0149492 | A1 | 6/2008 | Lin et al. | |
| 2008/0274375 | A1 * | 11/2008 | Ng et al. | 428/687 |
| 2010/0183869 | A1 | 7/2010 | Lin et al. | |
| 2011/0017602 | A1 | 1/2011 | Khosla | |
| 2011/0056836 | A1 | 3/2011 | Tatebe et al. | |
| 2011/0214993 | A1 | 9/2011 | Akana et al. | |

FOREIGN PATENT DOCUMENTS

| | | | |
|---|---|---|---|
| EP | 1 229 153 | A2 | 8/2002 |
| EP | 1 475 460 | A1 | 11/2004 |
| EP | 1 980 651 | A2 | 10/2008 |
| JP | 56101896 | | 8/1981 |
| JP | 56101896 | A * | 8/1981 |
| JP | S59038389 | | 2/1984 |
| JP | S64065294 | | 10/1989 |
| JP | H04017696 | | 1/1992 |
| JP | 2000234199 | | 8/2000 |
| JP | 2004091844 | | 3/2004 |
| JP | 2004124219 | | 4/2004 |
| JP | 2006183065 | | 7/2006 |
| WO | WO 88/08762 | A1 | 11/1988 |
| WO | 99/09549 | | 2/1999 |

OTHER PUBLICATIONS

"Effect of Abrasives on the Glossiness and Reflectance of Anodized Aluminum Alloys" by Shih et al., J. Mater. Sci. 43, pp. 1851-1858.*

Extended European Search Report for EP Application No. EP 10 17 3967, European Patent Office, Munich, Germany, mailed on Nov. 29, 2010, 8 pages.

"Notification of Transmittal of The International Search Report and The Written Opinion of The International Searching Authority, or The Declaration", PCT/US10/45498, mailed Sep. 30, 2010, 8 pgs.

Tatebe et al. "Anodization and Polish Surface Treatment," U.S. Appl. No. 12/554,596, filed Sep. 4, 2009.

Australian Examination Report, Application No. 2010289990, mailed Mar. 4, 2013.

European Office Action, Application No. 10 173 967.0, mailed Mar. 6, 2013.

Korean Patent Application No. 10-2012-7008617. Office Action dated Jul. 3, 2013.

US Office Action, U.S. Appl. No. 12/554,596, mailed Aug. 1, 2012.

U.S. Appl. No. 13/250,588, unpublished, filed Sep. 30, 2011, Hankey et al.

U.S. Appl. No. 13/322,288, unpublished, filed Dec. 20, 2011, Akana.

Japanese Application No. 2012-527893—Office Action dated Jun. 7, 2013.

Chinese Application for Invention No. 201080050279.4—First Office Action dated Feb. 27, 2014.

European Patent Application No. 10173967.0—Office Action dated Dec. 15, 2011.

European Patent Application No. 10173967.0—Office Action dated Aug. 5, 2014.

Japanese Patent Application No. 2013-229772—Office Action dated Nov. 14, 2014.

* cited by examiner

21

Polishing
22
Texturing
24
Polishing
26

23

Automated buffing
27
Manual buffing
28

41

Dyeing
42
Sealing
44
Polishing
46

43

Coarse buffing
48
Fine buffing
50

45

Tumbling
52
Coarse buffing
48
Fine buffing
50

47

Coarse tumbling
54
Fine tumbling
56
Fine buffing
50

ANODIZATION AND POLISH SURFACE TREATMENT

CROSS-REFERENCE TO RELATED APPLICATIONS

This application is a continuation in part of U.S. application Ser. No. 12/554,596, filed Sep. 4, 2009, which is incorporated by reference herein in its entirety.

BACKGROUND OF THE INVENTION

1. Field of the Invention

The present invention relates to treatments for a surface of an article. More particularly, the present invention relates to anodizing and polishing a surface of a metal article.

2. Background Art

Many products in the commercial and consumer industries are metal articles, or contain metal parts. The metal surfaces of these products may be treated by any number of processes to alter the surface to create a desired effect, either functional, cosmetic, or both. One example of such a surface treatment is anodization. Anodizing a metal surface converts a portion of the metal surface into a metal oxide, thereby creating a metal oxide layer. Anodized metal surfaces provide increased corrosion resistance and wear resistance. Anodized metal surfaces may also be used in obtaining a cosmetic effect, such as utilizing the porous nature of the metal oxide layer created by anodization for absorbing dyes to impart a color to the anodized metal surface.

The cosmetic effect of surface treatments to products that are metal articles, or have metal parts, can be of great importance. In consumer product industries, such as the electronics industry, visual aesthetics may be a deciding factor in a consumer's decision to purchase one product over another. Accordingly, there is a continuing need for new surface treatments, or combinations of surface treatments, for metal surfaces to create products with new and different visual appearances or cosmetic effects.

SUMMARY OF THE DISCLOSURE

A series of surface treatments may be performed on a surface of a metal part or article to create an integral layer having a desired cosmetic effect. The integral layer resembles a coating or layer that has been applied to the metal surface, but is actually an integral or intrinsic part of the metal article that has been treated to obtain the desired cosmetic effect. In other words, the integral or intrinsic layer is not a separate coating or film and the desired cosmetic effect is therefore achieved without the application of a separate coating or film, such as a lacquer or paint. The integral layer may be a coatingless layer that also has a sparkling effect, a rich color, and/or a glossy or shiny appearance. The integral layer may also provide additional characteristics such as corrosion and wear resistance. The integral layer may be applied to a broad range of metal articles including household appliances and cookware, automotive parts, athletic equipment, and electronic components.

In one embodiment, a method may include providing a metal part having a surface, polishing the surface, anodizing the surface to create an oxide layer after the step of polishing the surface, and polishing the oxide layer after the step of anodizing. The method may provide the metal part with an integral surface that is glossy.

In another embodiment, a method for treating a metal surface of a metal part to obtain an integral surface that is glossy is disclosed. The method may include providing a rough metal surface, forming a smooth surface from the rough metal surface, forming a surface with a plurality of peaks from the smooth surface, rounding the plurality of peaks, forming a metal oxide layer having a plurality of rounded peaks, imparting a color to the metal oxide layer, and forming a smooth surface from the colored metal oxide layer.

In yet another embodiment, a method for treating a surface of a metal part to obtain an integral surface that is glossy and sparkling is disclosed. The method may include providing the metal part, texturing the metal part to provide a surface with a plurality of peaks, polishing the textured metal part to round the plurality of peaks, anodizing the polished metal part, and polishing the anodized metal part.

BRIEF DESCRIPTION OF THE DRAWINGS

The accompanying drawings, which are incorporated herein and form a part of the specification, illustrate the present invention by way of example, and not by way of limitation. The drawings together with the description, further serve to explain the principles of the invention and to enable a person skilled in the pertinent art to make and use the invention.

DETAILED DESCRIPTION OF THE INVENTION

Figure 1:
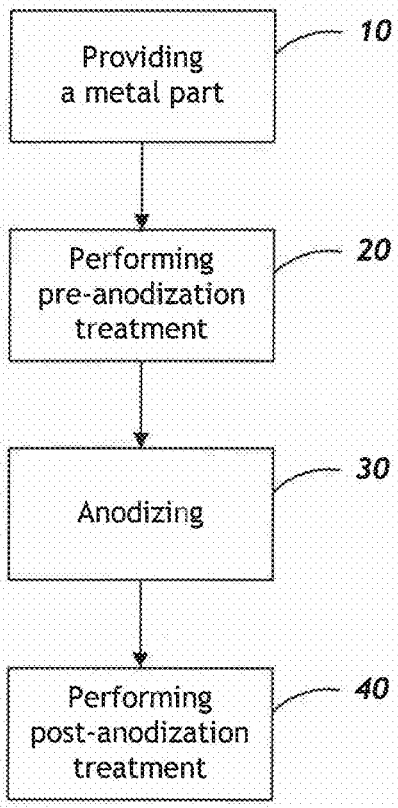
FIG. 1 is a flowchart of an exemplary method of surface treatment, in accordance with one embodiment of the present invention.

The present invention will be described with reference to the accompanying drawings, in which like reference numerals refer to similar elements. While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

A series of surface treatments may be performed on a surface of a metal part or article to create an integral layer having a desired cosmetic effect. The integral layer resembles a coating or layer that has been applied to the metal surface, but is actually an integral or intrinsic part of the metal article that has been treated to obtain the desired cosmetic effect. In other words, the integral or intrinsic layer is not a separate coating or film and the desired cosmetic effect is therefore achieved without the application of a separate coating or film, such as a lacquer or paint. The integral layer may be a coatingless layer that also has a sparkling effect, a rich color, and/or a glossy or shiny appearance. The integral layer may also provide additional characteristics such as corrosion and wear resistance. The integral layer may be applied to a broad range of metal articles including household appliances and cookware, automotive parts, athletic equipment, and electronic components.

In one embodiment, the integral layer may be achieved by anodizing the surface of a metal part or article, as well as performing one or more pre-anodizing surface treatments to the metal surface and performing one or more post-anodizing surface treatments to the metal surface. Possible pre-anodizing surface treatments may include polishing through buffing, texturing through an alkaline etch, and polishing with an acidic chemical solution. Possible post-anodizing surface treatments may include dyeing, sealing, and polishing through buffing, tumbling, or combinations thereof. Materials that may be processed using these techniques include, for example, aluminum, titanium, magnesium, niobium and the like. In one implementation, the metal part is formed from aluminum.

FIG. 1 is a high level flowchart of an exemplary method for treating a surface of a metal article or part in order to create an integral layer on the surface of the metal article having a desired cosmetic effect. The integral layer may be a coatingless layer that also has a sparkling effect, a rich color, and a glossy and/or shiny appearance. The integral layer is not a separate coating or film, but rather an integral or intrinsic part of the metal part. Accordingly, the desired cosmetic effect is achieved without the application of a separate coating or film, such as a lacquer or paint. The method may include a series of steps, the details of which will be discussed later in more detail. In some cases, the surface treatment may be applied to all surfaces of the metal part or article. In other cases, the surface treatment may be to a particular surface. In some other cases, the surface may only be applied to a portion of a particular surface.

The method may include a step 10 of providing a surface of a metal part or article. The metal part or article including each of its surfaces, may be formed using a variety of techniques, and may come in a variety of shapes, forms and materials. Examples of techniques include providing the metal part or article as a preformed sheet or extruding the metal part or article so that it is formed in a desired shape. Examples of metal materials include aluminum, titanium, magnesium, niobium and the like. In one example, the metal part or article may be extruded so the metal part or article is formed in a desired shape. Extrusion may be a process for producing a material in a desired shape in a continuous manner of indeterminate length so that the material may be subsequently cut to a desired length. In one example, the metal part or article may be formed from aluminum. In some embodiments, the metal part or article may be formed from extruded aluminum.

The method may also include a step 20 of performing one or more pre-anodization treatments on the surface of the metal part or article. By way of example, the pre-anodization treatments may include one or more of polishing and texturing. Polishing may be a process that smoothens a rough or bumpy surface. Examples of polishing may include buffing, applying an acid solution and/or the like. Texturing may be a process that changes the appearance, feel, or shape of a surface. Examples of texturing may include etching, sandblasting and/or the like. The one or more pre-anodization treatments may impart a sparkling effect to the metal surface. The one or more pre-anodization treatments may increase the gloss or shine of the metal surface.

Next, the method may include a step 30 of anodizing. By way of example, anodizing may include standard anodizing or hard anodizing. Anodization may be a process of increasing an oxide layer of a metal surface. Standard anodization may be an anodization process in which a metal surface is placed in an electrolytic bath having a temperature in a range between about 18 and 22 degrees Celsius. Hard anodization may be an anodization process in which a metal surface is placed in an electrolytic bath having a temperature in a range between about 0 and 5 degrees Celsius. In one embodiment, step 30 of anodizing may create a transparent effect to the metal surface.

The method may also include a step 40 of performing one or more post-anodization treatments. By way of example, the post-anodization treatment may include one or more of dyeing, sealing, and polishing. Dyeing may generally refer to dipping or immersing a metal surface in a dye solution. Sealing may generally refer to immersing a metal surface in a sealing solution to close pores on a surface of the article. Polishing is generally described above, but it should be noted that similar or different polishing techniques may be used. The one or more post-anodization treatments may impart a rich color to the metal surface. Additionally or alternatively, the one or more post-anodization treatments may impart a smooth, glassy appearance to the metal surface.

The method may be applied to a broad range of metal articles including, but not limited to, household appliances and cookware, such as pots and pans; automotive parts; athletic equipment, such as bikes; and electronic components, such as laptop computers and enclosures for electronic devices, such as media players, phones, and computers. In one embodiment, the method may be implemented on a media player manufactured by Apple Inc.

Figure 2:
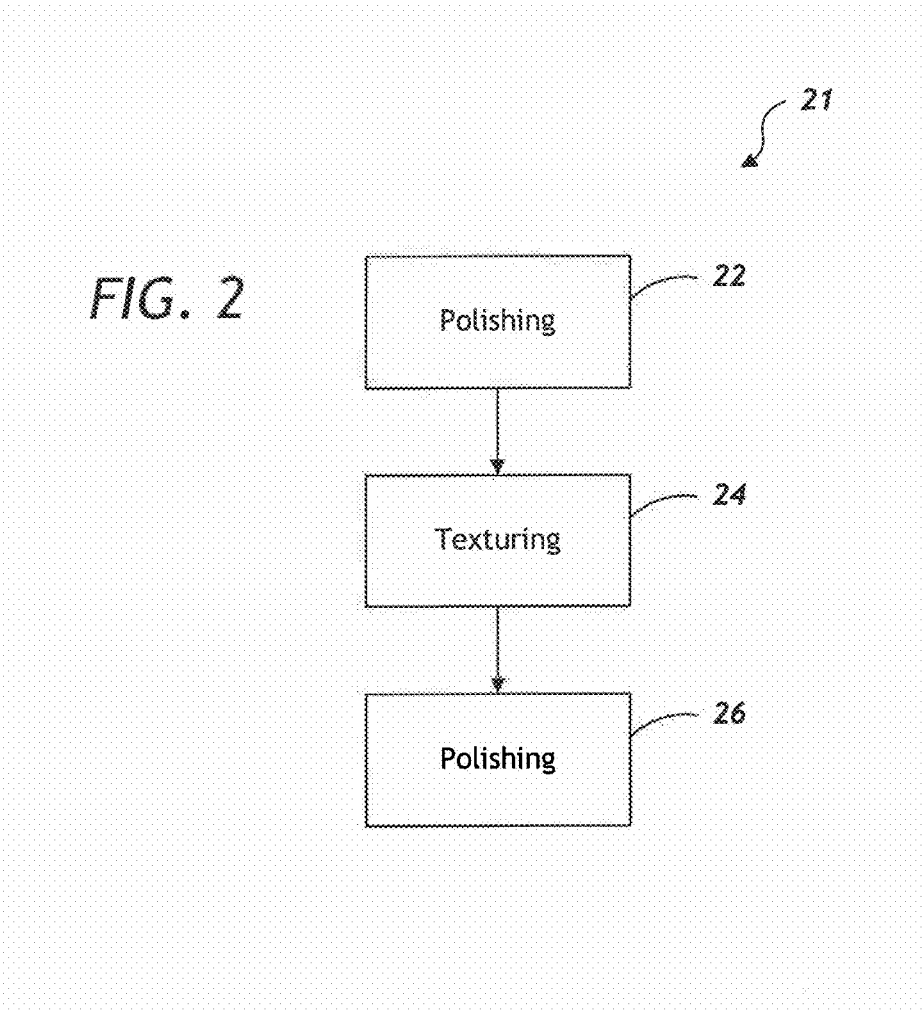
FIG. 2 is a flowchart of an exemplary pre-anodization surface treatment process from FIG. 1, in accordance with one embodiment of the present invention.

FIG. 2 illustrates a pre-anodization treatment process 21, in accordance with one embodiment. The pre-anodization treatment process 21 may, for example, correspond to step 20 shown in FIG. 1.

Process 21 may include a step 22 of polishing. By way of example, the polishing of step 22 may include buffing. The buffing may be either automated or manual. Buffing may be a process of polishing using a work wheel having an abrasive surface. Step 22 of polishing may turn a metal surface into a smooth, flat, shiny, mirror-like surface.

Process 21 may also include a subsequent step 24 of texturing. By way of example, the texturing of step 24 may be a chemical process, such as etching, or may be a sandblasting process. Step 24 of texturing may impart a "peaky" effect to the metal surface wherein the surface has a series of peaks and valleys. The peaks and valleys may create a sparkling effect to the surface.

Process 21 may also include a further subsequent step 26 of polishing. By way of example, the polishing of step 26 may include chemical polishing, such as in an acid solution. Step 26 of polishing may round the peaks created in step 24 of texturing. Step 26 of polishing may increase the gloss or shine of the surface. The details of polishing and texturing will be discussed in greater detail below.

Figure 3:
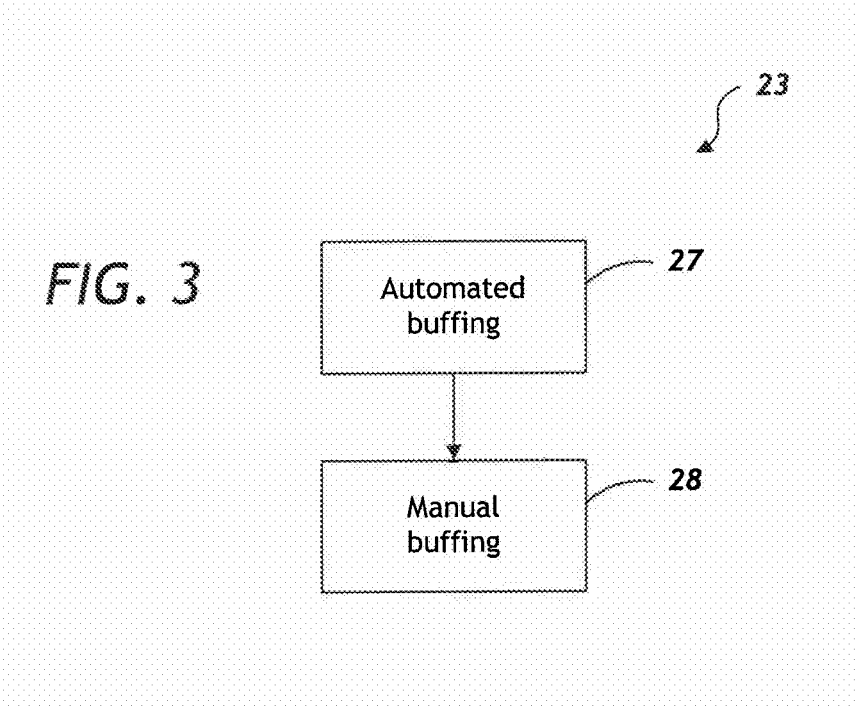
FIG. 3 is a flowchart of an exemplary polishing process from FIG. 2, in accordance with one embodiment of the present invention.

FIG. 3 illustrates a polishing treatment process 23, in accordance with one embodiment. The polishing treatment process 23 may, for example, correspond to step 22 shown in FIG. 2. As shown in FIG. 3, process 23 may include multiple steps of buffing including automated and/or manual buffing. The order, sequence, and number of buffing steps may be varied to produce the desired finish. For example, process 23 may include an automated buffing step 27. Process 23 may also include a subsequent manual buffing step 28. The details of the buffing steps will be discussed later in more detail.

Figure 4:
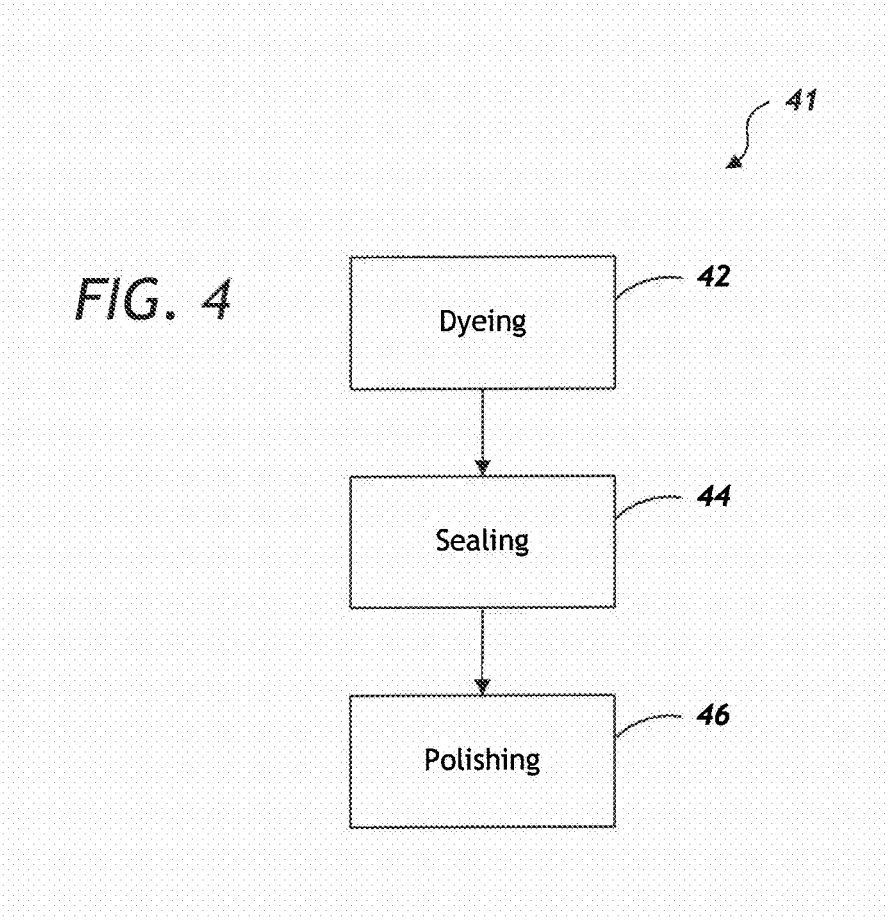
FIG. 4 is a flowchart of an exemplary post-anodization surface treatment process from FIG. 1, in accordance with one embodiment of the present invention.

FIG. 4 illustrates a post-anodization treatment process 41 in accordance with one embodiment. The post-anodization treatment process 41 may, for example, correspond to step 40 shown in FIG. 1.

Process 41 may include a step 42 of dyeing. By way of example, step 42 of dyeing may include dipping or immersing a metal surface in a dye solution. Step 42 of dyeing may impart a rich color to the surface.

Process 41 may also include a subsequent step 44 of sealing. By way of example, step 44 of sealing may include immersing a metal surface in a sealing solution. Step 44 of sealing may seal pores on the surface of the metal part or article being treated.

Process 41 may also include a further subsequent step 46 of polishing. By way of example, step 46 of polishing may include buffing, tumbling, or combinations thereof. Tumbling may be a process of polishing an object by placing the objecting in a tumbling barrel filled with a media and then rotating the barrel with the object inside it. Step 46 of polishing may impart a smooth, glassy appearance to the surface.

Figure 5:
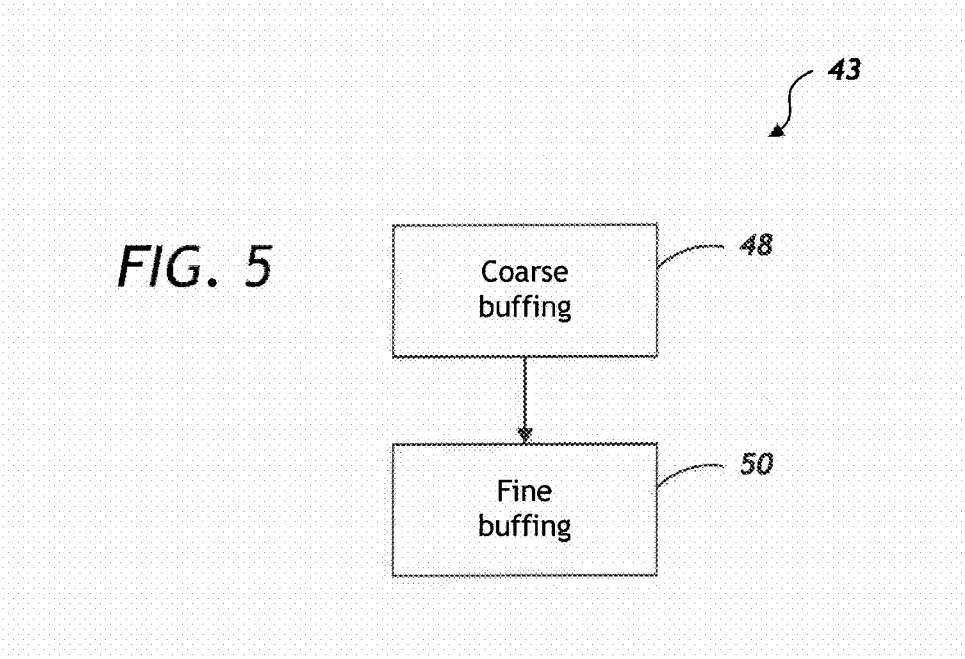
FIG. 5 is a flowchart of an exemplary polishing process from FIG. 4, in accordance with one embodiment of the present invention.

FIG. 5 illustrates one embodiment of an exemplary polishing treatment process 43. The polishing treatment process 43 may, for example, correspond to step 46 shown in FIG. 4. Process 43 may include coarse and/or fine buffing. The order, sequence and number of buffing steps can be varied to produce the desired finish. Process 43 may include a step 48 of coarse buffing. Process 43 may also include a subsequent step 50 of fine buffing.

Figure 6:
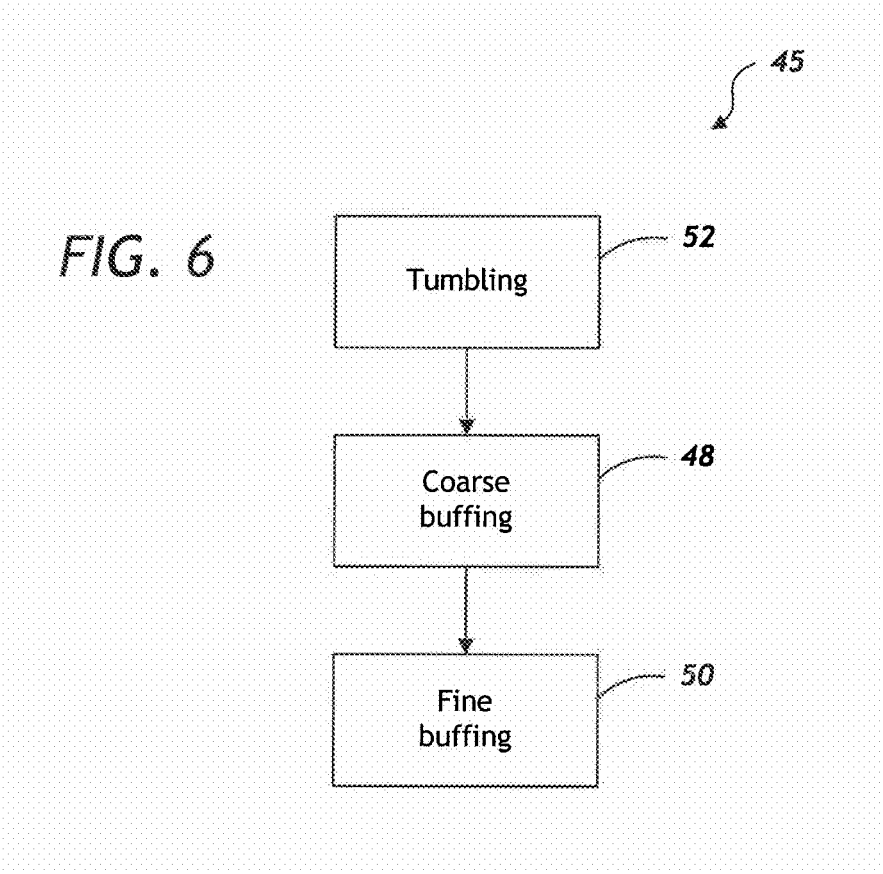
FIG. 6 is a flowchart of another exemplary polishing process from FIG. 4, in accordance with one embodiment of the present invention.

FIG. 6 illustrates one embodiment of an exemplary polishing treatment process 45. The polishing treatment process 45 may, for example, correspond to step 46 shown in FIG. 4. Process 45 may include tumbling and/or buffing. Buffing may include coarse and/or fine buffing. The order, sequence and number of steps may be varied to produce the desired finish. In one embodiment, process 45 may include a step 52 of tumbling. Process 45 may also include a subsequent step 48 of coarse buffing. Process 45 may also include a subsequent step 50 of fine buffing.

Figure 7:
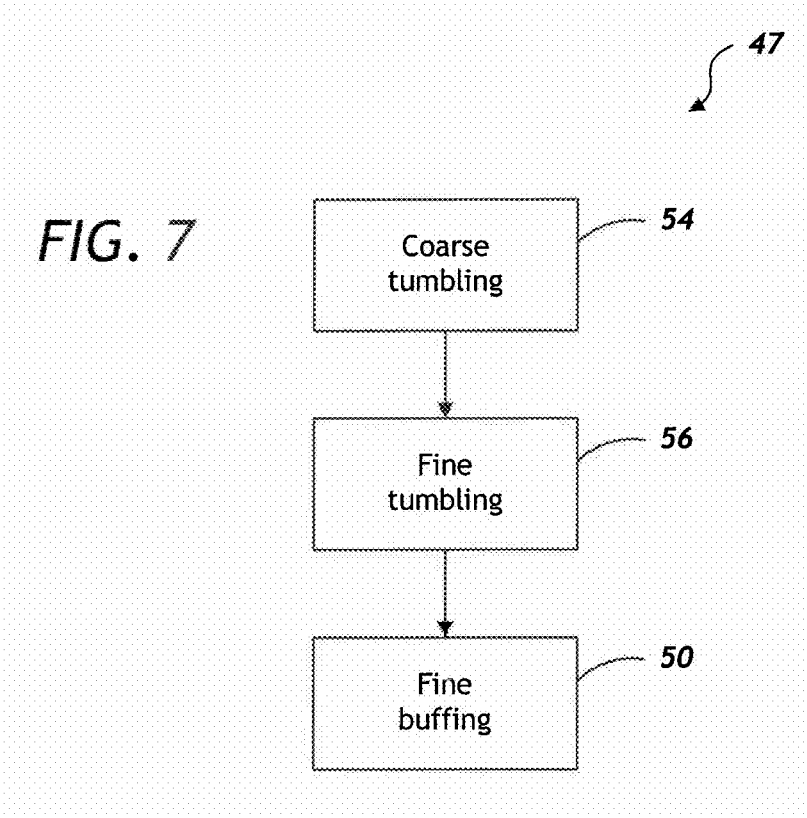
FIG. 7 is a flowchart of still another exemplary polishing process from FIG. 4, in accordance with one embodiment of the present invention.

FIG. 7 illustrate one embodiment of an exemplary polishing treatment process 47. The polishing treatment process 47 may, for example, correspond to step 46 shown in FIG. 4. Process 47 may include coarse and/or fine buffing. The order, sequence and number of steps may be varied to produce the desired finish. In one embodiment, process 47 may include a step 54 of coarse tumbling. Process 47 may also include a subsequent step 56 of fine tumbling. Process 47 may also include a further subsequent step 50 of fine buffing.

It is noted that the steps discussed above, illustrated in the flowcharts of FIGS. 1-7 are for illustrative purposes and are merely exemplary. Not every step need be performed and additional steps may be included as would be apparent to one of ordinary skill in the art to create an integral layer on the surface of the metal article having a desired cosmetic effect. In one embodiment an integral, glossy layer may be created. The integral layer may be a coatingless layer that also has a sparkling effect, a rich color, and/or a glossy or shiny appearance. The integral layer is not a separate coating or film, but rather is an integral or intrinsic part of the metal article. Accordingly, the desired cosmetic effect is achieved without the application of a separate coating or film, such as a lacquer or paint.

Figure 8:
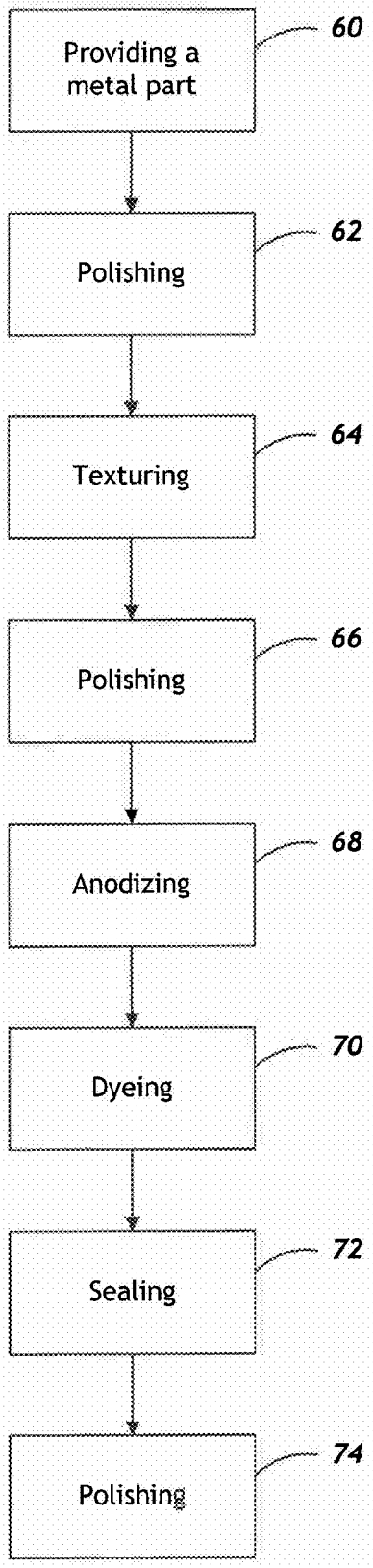
FIG. 8 is a flowchart of another exemplary method of surface treatment, in accordance with one embodiment of the present invention.

FIG. 8 is an exemplary flowchart of a method for treating a surface which may include one or more of the steps previously outlined in FIGS. 1, 2, and 4. A more detailed discussion of each of the steps follows, along with a discussion of accompanying FIGS. 9-16, which illustrate an enlarged view of a surface after each step of the method outlined in FIG. 8 has been performed. FIG. 17 is an exemplary flowchart describing a method for treating a surface describing the sequential surface changes that are illustrated in FIGS. 9-16.

Figure 9:
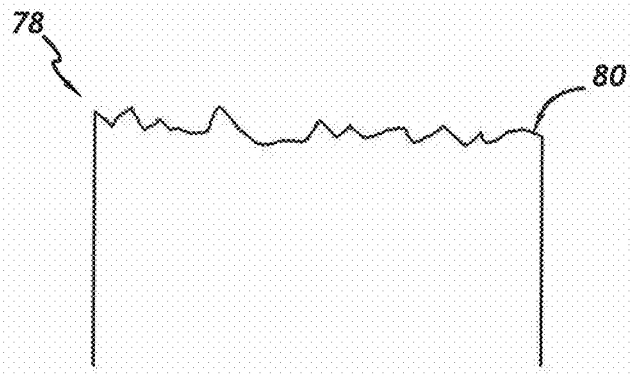
FIG. 9 is an enlarged view of a cross-section of a portion of an exemplary surface prior to treatment, in accordance with one embodiment of the present invention.

Referring to FIG. 8, a step 60 includes providing the metal surface of a metal part or article as the raw material that is to be treated. The metal part may be provided in the form of a preformed sheet or may be extruded so the metal part is formed in a desired shape. A variety of metals and metal alloys may be treated, including, but not limited to aluminum, magnesium, titanium, and alloys thereof. In one embodiment, the metal part may be extruded. In another embodiment, the metal part may be extruded aluminum. In a further embodiment, the metal part may be extruded 6063 grade aluminum. The grade and type of metal may be varied to achieve different effects upon surface treatment. Step 60 of providing the metal surface may, for example, correspond to step 10 shown in FIG. 1. As shown in FIG. 9, a metal part or article 78 with a surface 80 provided in step 60 may have a surface 80 that is rough and bumpy.

As shown in FIG. 17, in a process for treating surface 80, surface 80, as shown in FIG. 9 with a rough and bumpy surface, may be achieved through a step 102 of providing a rough metal surface. Step 102 may be accomplished using step 60 described above.

Figure 10:
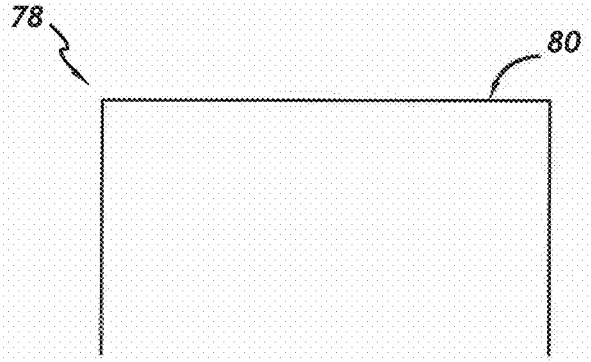
FIG. 10 is an enlarged view of a cross-section of a portion of an exemplary surface after a step 22 of polishing from FIG. 2, in accordance with one embodiment of the present invention.

In step 62, surface 80 of metal part 78 is polished. Polishing may be accomplished through buffing to turn surface 80 into a smooth, flat, shiny, mirror-like surface, as shown in FIG. 10. Surface 80 may be polished to have a surface roughness Ra of about 0.1 μm or less, about 0.075 μm or less, about 0.05 μm or less, or about 0.025 μm or less. Buffing may be accomplished with a buffing wheel either manually or in an automated process by a robot, or combinations therein. The buffing wheel may be a cloth wheel and may be covered in an oil or wax having abrasive particles mixed or suspended therein. In order to obtain a smooth, flat, shiny, mirror-like surface it may be necessary to perform several buffing steps. As discussed previously, step 62 may include several buffing steps. Each buffing procedure may have a different cloth material for the buffing wheel and a different wax or oil with different abrasive particles applied thereto to provide a different surface texture to the buffing wheel, and therefore a different amount of abrasion to surface 80 of the metal part. The amount of pressure and duration of the buffing for each buffing wheel may also vary. Step 62 of polishing may, for example, correspond to step 22 shown in FIG. 2.

In one embodiment, step 62 of polishing may for example correspond to process 23 shown in FIG. 3 that includes automated buffing step 27 followed by manual buffing step 28. Automated buffing step 27 may be a multi-stage process. An exemplary multi-stage process for automated buffing step 27 may include six stages. In a first stage, surface 80 may be buffed for about 17 seconds with a pleated sisal wheel coated with an oil having coarse aluminum oxide particles suspended therein. In a second stage, surface 80 may be buffed in a cross direction from the buffing of the first stage for about 17 seconds with a pleated sisal wheel coated with an oil having coarse aluminum oxide particles suspended therein. In a third stage, surface 80 may be buffed for about 17 seconds with a pleated sisal wheel coated with an oil having coarse aluminum oxide particles suspended therein. In a fourth stage, surface 80 may be buffed for about 17 seconds with a pleated sisal wheel coated with an oil having coarse aluminum oxide particles suspended therein. In a fifth stage, surface 80 may be buffed for about 17 seconds with an un-reinforced cotton wheel coated with an oil having finer aluminum oxide particles suspended therein than the coarse aluminum oxide particles utilized in the first through fourth stages. In a sixth stage, surface 80 may be buffed for about 17 seconds with a flannel wheel coated with an oil having finer aluminum oxide particles suspended therein than the coarse aluminum oxide particles utilized in the first through fourth stages. The type of abrasive particles, the size of the abrasive particles, the duration of the stage, and the material of the wheel described above for each stage, as well as the number of stages, are merely exemplary and may be varied.

In one embodiment, manual buffing step 28 may be a multi-stage process. An exemplary multi-stage process for manual buffing step 28 may include two stages. In a first stage, surface 80 may be buffed in a range from between about 60 and 90 seconds with a pleated sisal wheel coated with a wax having fine aluminum oxide particles suspended therein. The path of the wheel may be randomized in the first stage in order to remove polish lines from automated buffing step 27. In a second stage, surface 80 may be buffed for about 40 seconds to remove polish lines from the first stage of step 28 with an un-reinforced cotton wheel coated with a wax having very fine aluminum oxide particles suspended therein that a finer than the aluminum oxide particles utilized in the first stage. The type of abrasive particles, the size of the abrasive particles, the duration of the stage, and the material of the wheel described above for each stage, as well as the number of stages, are merely exemplary and may be varied.

The quality of surface 80 after polishing step 62 determines the final surface quality after all treatments have completed. Polishing step 62 should result in a high quality surface with no orange peel, no waviness, and no defects. All die lines, stamping marks, drawing marks, shock lines, cutter marks, roughness, waviness, and/or oil and grease should be removed from surface 80 during polishing step 62. Buffing is merely an exemplary method for accomplishing the polishing in step 62 and other polishing methods may be utilized that would result in turning rough and bumpy surface 80 into a smooth, flat, shiny, mirror-like surface and achieve the requirements described above.

As shown in FIG. 17, in a process for treating surface 80, surface 80, as shown in FIG. 10 with a smooth, flat, shiny, mirror-like surface, may be achieved through a step 104 of forming a smooth surface from the rough metal surface provided in step 102. Step 104 may be achieved using step 62 of polishing described above.

Figure 11:
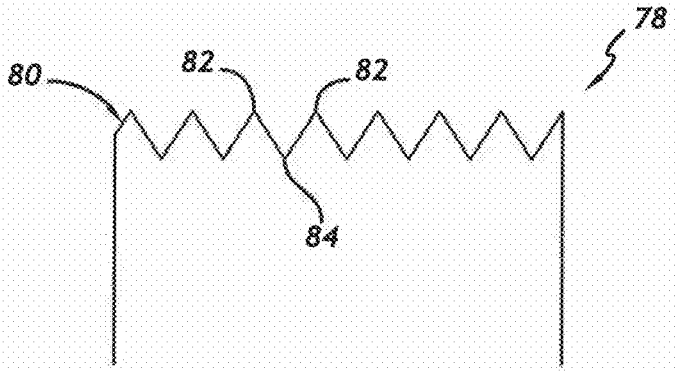
FIG. 11 is an enlarged view of a cross-section of a portion of an exemplary surface after a step 24 of texturing from FIG. 2, in accordance with one embodiment of the present invention.

A step 64 includes texturing surface 80 of metal part 78 to impart a desired fine texture to surface 80. Texturing may include a chemical process such as etching surface 80 with an alkaline etching solution. The alkaline etching solution textures the previously smooth surface 80 to be "peaky" with a low gloss or matte appearance. As shown in FIG. 11, after texturing surface 80 of the metal part may be "peaky" in that it has several peaks 82 and valleys 84 between adjacent peaks 82. Peaks 82 and valleys 84 also create a sparkling effect to surface 80 based on how light reflects off the "peaky" surface. In some embodiments, peaks 82 may have a pointed apex as shown in FIG. 11, however this is merely exemplary. The shape of peaks 82 and valleys 84 may be varied. In some embodiments, adjacent peaks 82, and therefore adjacent valleys 84, may be evenly spaced apart. In other embodiments, adjacent peaks 82, and therefore adjacent valleys 84, may be randomly spaced apart.

The alkaline etching solution may be a sodium hydroxide (NaOH) solution. The concentration of the NaOH solution may range between about 50 and 60 g/l, 51 and 59 g/l, 52 and 58 g/1, 53 and 57 g/l, or 54 and 56 g/l, or may be about 55 g/l. The NaOH solution may have a temperature of about 50 degrees Celsius. Surface 80 may be exposed to the NaOH solution for a time period that may range between about 5 and 30 seconds, about 10 and 25 seconds, or about 15 and 20 seconds. These parameters are merely exemplary and may be varied. Sodium hydroxide is merely an exemplary alkaline etching solution and other alkaline etching solutions may be utilized, including, but not limited to ammonium bifluoride ($NH_4F_2$). In addition, texturing may be accomplished utilizing other methods, for example sandblasting, that would result in texturing surface 80 to have several peaks 82 and valleys 84, and thereby create a sparkling effect. Step 64 of texturing may, for example, correspond to step 24 shown in FIG. 2.

As shown in FIG. 17, in a process for treating surface 80, surface 80, as shown in FIG. 11 with a "peaky" surface having a sparkling effect, may be achieved through a step 106 of forming a surface with peaks and troughs from the smooth surface provided in step 104. Step 106 may be achieved using step 64 of texturing described above.

Figure 12:
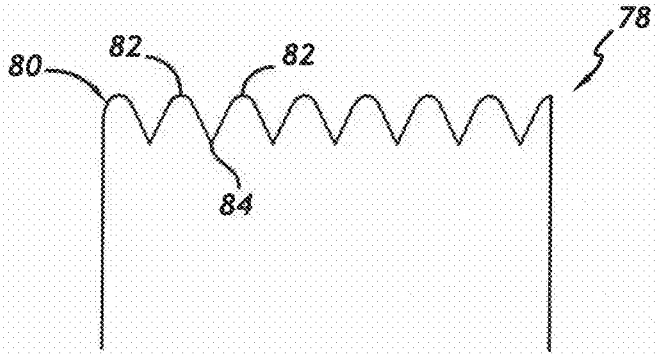
FIG. 12 is an enlarged view of a cross-section of a portion of an exemplary surface after a step 26 of polishing from FIG. 2, in accordance with one embodiment of the present invention.

In a step 66, surface 80, which is textured to have peaks 82 and valleys 84 to create a sparkling effect, is polished. A chemical polishing process may be utilized wherein surface 80 is exposed to a solution that rounds peaks 82 so they are no longer pointy, as shown in FIG. 12. The sparkling effect is still present and the chemical polishing process also increases the gloss of surface 80 so that surface 80 is also shiny. The length of time surface 80 is exposed to the chemical polishing solution increases the level of gloss. The level of gloss in turn determines a depth of valleys 84 because an increase in gloss is caused by an increase in the roundedness of peaks 82, which in turn decreases the depth of valleys 84. Surface 80 may be exposed to the chemical polishing solution until a desired depth of valleys 84 is achieved, which may be determined by a visual inspection. Alternatively, surface 80 may be exposed to the chemical polishing solution until a desired amount of gloss is achieved, which may be determined by a gloss meter. In some embodiments, in order to achieve the desired texture and sparkling effects, the gloss value of surface 80 measured at 20 degrees by a 20 degree gloss meter after the completion of step 66 may be in a range between about 130 and 280 gloss units, 140 and 270 gloss units, 150 and 260 gloss units, 160 and 250 gloss units, 170 and 240 gloss units, 180 and 230 gloss units, 190 and 220 gloss units, 200 and 210 gloss units, or about 205 gloss units. The above gloss values are merely exemplary and a desired texture and sparkling effect may also be achieved with a surface 80 that has a different gloss value after the completion of step 66. In some embodiments, a visual inspection may be performed, for example with the aid of a loupe, to ensure surface 80 has a desired texture. In some embodiments, a visual inspection may be performed, for example by shining a high intensity spotlight on surface 80, to ensure surface 80 has a desired sparkling effect.

The chemical polishing solution may be an acidic solution. Acids that may be included in the solution include, but are not limited to, phosphoric acid ($H_3PO_4$), nitric acid ($HNO_3$), sulfuric acid ($H_2SO_4$), and combinations thereof. The acid may be phosphoric acid, a combination of phosphoric acid and nitric acid, a combination of phosphoric acid and sulfuric acid, or a combination of phosphoric acid, nitric acid and sulfuric acid. Other additives for the chemical polishing solution may include copper sulfate ($CuSO_4$) and water. In one embodiment, a solution of 85% phosphoric acid is utilized that is maintained at a temperature of 95 degrees Celsius. The processing time of step 66 is adjusted depending upon a desired target gloss value. In one embodiment, the processing time may be in a range between about 40 and 60 seconds. In addition, the polishing of step 66 may be accomplished utilizing other methods that would result in polishing surface 80 to increase the gloss of surface 80. Step 66 of polishing may, for example, correspond to step 26 shown in FIG. 2.

As shown in FIG. 17, in a process for treating surface 80, surface 80, as shown in FIG. 12 with a surface having rounded peaks and increased gloss or shine, may be achieved through a step 108 of rounding the peaks created in step 106. Step 108 may be achieved using step 66 of polishing described above.

Figure 13:
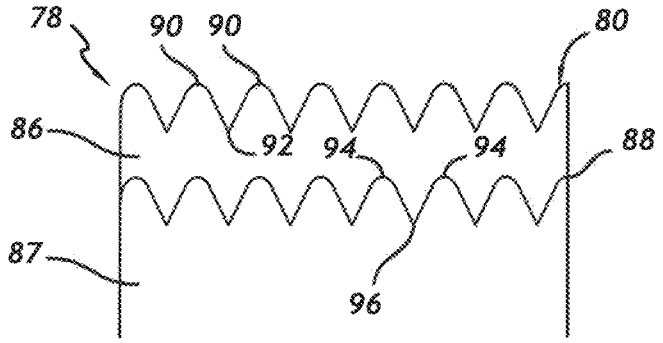
FIG. 13 is an enlarged view of a cross-section of a portion of an exemplary surface after a step 30 of anodizing from FIG. 1, in accordance with one embodiment of the present invention.

A step 68 includes anodizing glossy surface 80 to create a metal oxide layer 86 by converting a portion of metal part 78 to metal oxide, as shown in FIG. 13. Accordingly anodizing does not increase the thickness of metal part 78, but rather converts a portion of metal part 78 to metal oxide. When oxide layer 86 is formed, outer surface 80 maintains the same contour it had from the previous treatment step with rounded peaks 90 and valleys 92. In addition, a transition line 88 between metal oxide layer 86 and the remaining metal region 87 of metal part 78 is formed that has the same contour as surface 80 with rounded peaks 94 and valleys 96. This results in oxide layer 86 forming a glossy, sparkling layer that is integrally formed from metal part 78, but resembles a separately applied coating or finishing layer even though it is not separately applied. The integral layer resembles a coating or layer that has been applied to surface 80, but is actually an integral or intrinsic part of metal article 78 that has been treated to obtain the desired cosmetic effect, i.e. the integral layer is not a separate coating or film. The thickness of oxide layer 86 may be controlled so that oxide layer 86 has a transparent effect so transition line 88 may be seen. The greater the thickness of oxide layer 86 the more translucent, e.g. less transparent, oxide layer 86 becomes. In order to achieve an oxide layer 86 with sufficient transparency the thickness of oxide layer 86 may range between about 10 and 20 microns, about 11 and 19 microns, about 12 and 18 microns, about 13 and 17 microns, or about 14 and 16 microns or may be about 15 microns. The above ranges for the thickness of oxide layer 86 are not intended to be limiting.

The anodizing process may include placing metal part 78 in an electrolytic bath that has been optimized to increase the transparent effect of the oxide layer 86. The electrolytic bath may include sulfuric acid ($H_2SO_4$) in a concentration having a range between about 150 and 210 g/l, about 160 and 200 g/l, or about 170 and 190 g/l, or may be about 180 g/l. The electrolytic bath may also include metal ions of that are the same as metal part 58, for example aluminum ions, in a concentration of about less than 15 g/l or in a range between about 4 and 10 g/l, about 5 and 9 g/l, or about 6 and 8 g/l, or may be about 7 g/l. Step 68 of anodizing may be a standard anodization process wherein the electrolytic bath may be maintained at a temperature in a range between about 18 and 20 degrees Celsius. In one embodiment, the temperature of the electrolytic bath should not be above 22 degrees Celsius. Anodization may occur at a current density in a range between about 1.0 and 1.2 amperes per square decimeter. Anodization may have a duration in a range between about 30 and 60 minutes, about 35 and 55 minutes, or about 40 and 50 minutes, or may be about 45 minutes. The thickness of the oxide layer may be controlled in part by the duration of the anodization process. In other embodiments, step 68 of anodizing may be a hard anodization process. Step 68 of anodizing may, for example, correspond to step 30 shown in FIG. 1.

As shown in FIG. 17, in a process for treating surface 80, metal oxide layer 86, as shown in FIG. 13 with rounded peaks having a transparent effect, may be achieved through a step 110 of forming a metal oxide layer having rounded peaks. Step 110 may be achieved using step 68 of anodizing described above.

Figure 14:
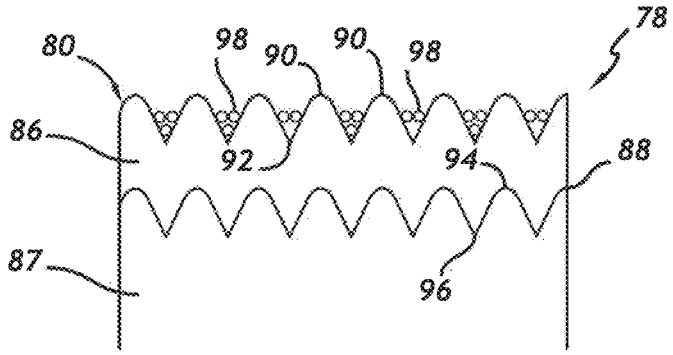
FIG. 14 is an enlarged view of a cross-section of a portion of an exemplary surface after a step 42 of dyeing from FIG. 4, in accordance with one embodiment of the present invention.

In a step 70, metal part 78 may be dyed to impart a rich color to surface 80. Metal oxide layer 86 formed during step 66 of anodizing, is porous in nature allowing metal oxide layer 86 to absorb a dye through its pores (not shown) to impart a rich color to surface 80. Metal oxide layer 86 may also possess increased adherence capabilities for dyes than metal. Beads of dye 98 flow into pores (not shown) of metal oxide layer 86 and adhere to surface 80 to impart a color to surface 80, as shown in FIG. 14. The dyeing process may be accomplished through the typical method of dipping or immersing surface 80 into a dye solution containing a dye which will impart a desired color to surface 80. In some embodiments, the dye solution may be maintained at a temperature in a range between about 50 and 55 degrees Celsius. In some embodiments, the dye solution may contain a stabilizer to control the pH. Dyes that may be used should be selected that will maintain a rich, vibrant color after step 74 of polishing, discussed below. Color control may be achieved by measuring dyed surface 80 with a spectrophotometer and comparing the value against an established standard. Step 70 of dyeing may, for example, correspond to step 42 shown in FIG. 4.

As shown in FIG. 17, in a process for treating surface 80, a metal oxide layer 86, as shown in FIG. 14 with a rich color, may be achieved through a step 112 of imparting a color to the metal oxide layer formed in step 110. Step 112 may be achieved using step 70 of dyeing described above.

Figure 15:
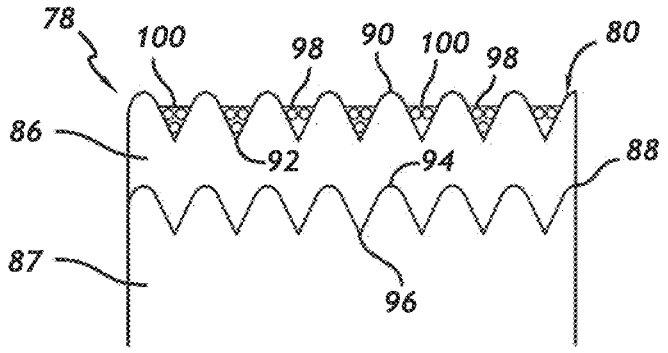
FIG. 15 is an enlarged view of a cross-section of a portion of an exemplary surface after a step 44 of sealing from FIG. 4, in accordance with one embodiment of the present invention.

Step 72 includes sealing porous metal oxide layer 86 to seal the pores of oxide layer 86. The sealing process may include placing surface 80 in a solution for a sufficient amount of time to create a sealant layer 100 that seals the pores of surface 80 of metal oxide layer 86, as shown in FIG. 15. The sealing solution may include, but is not limited to, nickel acetate. The sealing solution may be kept at a temperature in a range between about 90 and 95 degrees Celsius. Surface 80 may be immersed in the solution for a period of at least 15 minutes. Step 72 of sealing may, for example, correspond to step 44 shown in FIG. 4.

Figure 16:
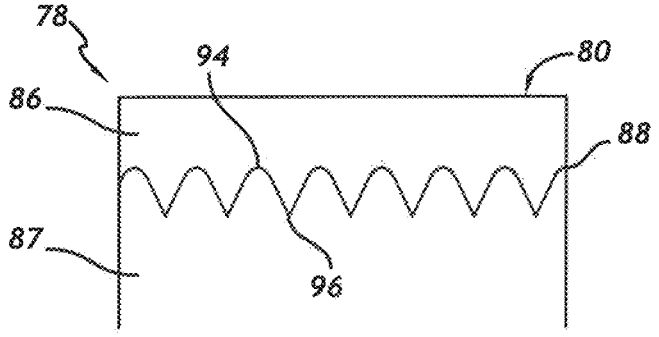
FIG. 16 is an enlarged view of a cross-section of a portion of an exemplary surface after a step 46 of polishing from FIG. 4, in accordance with one embodiment of the present invention.
Figure 17:
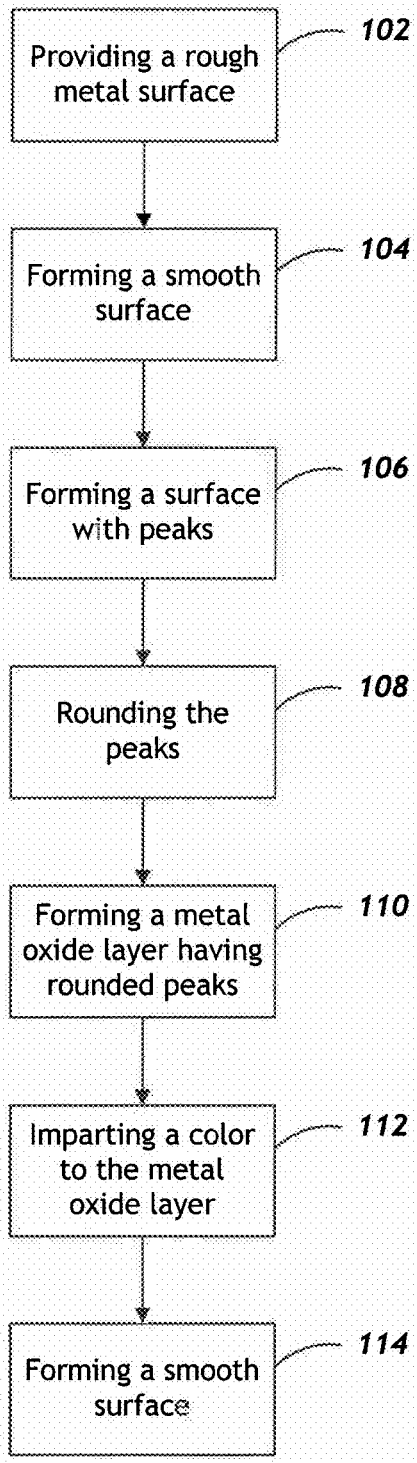
FIG. 17 is a flowchart of another exemplary method of surface treatment, in accordance with one embodiment of the present invention.

In a step 74, surface 80 may be polished to create a smooth, glassy appearance as shown in FIG. 16. Metal oxide layer 86 remains after polishing, but a portion of metal oxide layer 86 is removed during the polishing process. Thus, the polishing process may remove peaks 90 and valley 92 of surface 80, but peaks 94 and valleys 96 of transition line 88 remain so that the sparkling effect is still present. The polishing process may include, but is not limited to, buffing, tumbling, and combinations thereof. The methods for performing step 74 described below are exemplary. Whatever method is utilized, the removal of material during the polishing process should be uniform and consistent to maintain a uniform color of surface 80 and special care should be taken for edges and corners. In addition, after step 74, surface 80 may have a surface roughness Ra of about 0.1 μm or less, about 0.075 μm or less, about 0.05 μm or less, or about 0.025 μm or less. Step 74 of polishing may, for example, correspond to step 46 shown in FIG. 4.

In one embodiment, step 74 of polishing surface 80 may, for example, correspond to process 43 shown in FIG. 5. Process 43 includes step 48 of subjecting surface 80 to a coarse buffing. Process 43 subsequently includes step 50 of subjecting surface 80 to a fine buffing. As described above with respect to step 62, buffing may be accomplished with a buffing wheel either manually or by an automated process, for example with a robot, or combinations thereof. The buffing wheel may be a cloth wheel and may be covered in a wax or oil having abrasive particles mixed or suspended therein. Each of steps 48 and 50 may have a different cloth material for the buffing wheel and a different wax with different abrasive particles applied thereto to provide a different surface texture to the buffing wheel, and therefore a different amount of abrasion to surface 80 of the metal part. The combination of cloth material, wax, and abrasive particles utilized in step 48 is chosen to provide a buff that is coarser than the buff of step 50. For example, step 48 may include buffing surface 80 with a pleated sisal wheel coated with a wax having aluminum oxide particles suspended therein for about two minutes, or alternatively for about four minutes Similarly, the combination of cloth material, wax, and abrasive particles utilized in step 50 is chosen to provide a buff that is finer than the buff of step 48. For example, step 50 may include buffing surface 80 with an un-reinforced cotton wheel coated with a wax having aluminum oxide particles suspended therein for about one minute. The aluminum oxide particles utilized in step 50 may have a sub-micron size and are smaller than the aluminum oxide particles utilized in step 48.

In another embodiment, step 74 of polishing surface 80 may, for example, correspond to process 45 shown in FIG. 6. Process 45 includes step 52 of tumbling metal part or article 78 to polish surface 80. Process 45 subsequently includes a step subjecting surface 80 to buffing, such as step 48 of providing a coarse buff. Process 45 may also include an additional step of buffing surface 80, such as step 50 of providing a fine buff. Tumbling may be accomplished by placing metal part or article 78 into a tumbling barrel filled with a media. The barrel is rotated and the metal part or article 78 is rotated inside along with the media, which causes the media to collide with surface 80, thereby polishing and smoothing surface 80. For example, step 52 may include tumbling metal part or article 78 in a barrel for about 2 hours at a rotational speed of about 140 RPM. The barrel may be about 60% filled and the media may be crushed walnut shells mixed with a cutting media suspended in a lubricant, such as a cream. Step 48 of coarse buffing may occur as previously discussed above. Step 50 of fine buffing may occur as previously discussed above.

In still another embodiment, step 74 of polishing surface 80 may, for example, correspond to process 47 shown in FIG. 7. Process 47 includes step 54 of subjecting metal part or article 78 to a coarse tumbling. Process 47 subsequently includes step 56 of subjecting metal part or article 78 to a fine tumbling. Afterwards, the surface 80 may be subjected to a step of buffing, such as step 50 of providing a fine buff. The media utilized in step 54 is chosen to provide a polish that is coarser than the polish of step 56. Similarly, the media utilized in step 56 is chosen to provide a polish that is finer than the polish of step 54. For example, step 54 may include tumbling metal part or article 78 in a barrel for about 2 hours at a rotational speed of about 140 RPM. The barrel may be about 60% filled and the media may be crushed walnut shells mixed with a cutting media suspended in a lubricant, such as a cream. Similarly, for example, step 56 may be operated under the same conditions as step 54 except the walnut shells are more finely crushed in the media of step 56 than the media of step 54. Step 50 of fine buffing may occur as previously discussed above.

As shown in FIG. 17, in a process for treating surface 80, metal oxide layer 86, as shown in FIG. 16 with a smooth, glassy appearance, may be achieved through a step 114 of forming a smooth surface from the surface provided in step 112. Step 114 may be achieved using step 74 of polishing described above.

As previously noted, the ordering of steps discussed above, illustrated in the flowcharts of FIGS. 1-8 are for illustrative purposes and are merely exemplary. Accordingly, the steps may be varied. Not every step need be performed and additional steps may be included, as would be apparent to one of ordinary skill in the art, to create an integral layer on the surface of the metal article having a desired cosmetic effect. In one embodiment an integral layer may be created. The integral layer may be a coatingless layer that also has a sparkling effect, a rich color, and/or a glossy or shiny appearance. The integral layer is not a separate coating or film, but rather is an integral or intrinsic part of the metal article. Accordingly, the desired cosmetic effect is achieved without the application of a separate coating or film, such as a lacquer or paint. Additional steps may include, but are not limited to, rinsing surface 80, degreasing surface 80, activating anodized surface 80, neutralizing surface 80, and/or de-smutting surface 80, as necessary.

Figure 18:
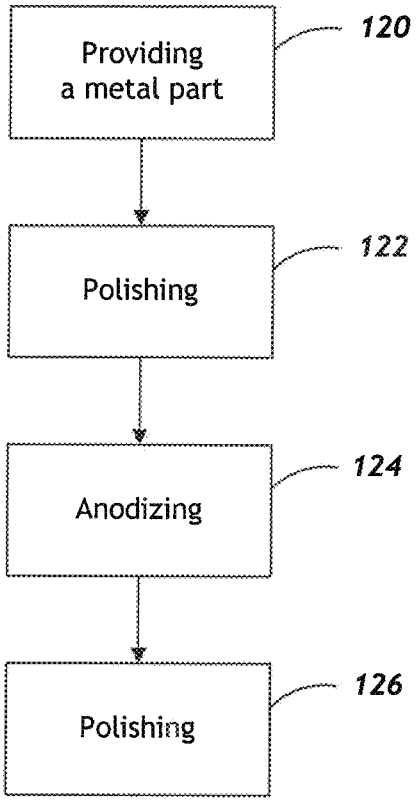
FIG. 18 is a flowchart of another exemplary method of surface treatment, in accordance with one embodiment of the present invention.

In one embodiment, the process illustrated in FIG. 1, may include a single pre-anodizing step of polishing and a single post-anodizing step of polishing. Accordingly, in one embodiment, as shown for example in FIG. 18, a method for treating a metal surface may include step 120 of providing a metal part. Step 120 may, for example, correspond to step 60 shown in FIG. 8 Next, the method may include step 122 of polishing. Step 122 may, for example, correspond to step 62 shown in FIG. 8. Subsequently, the method may include step 124 of anodizing. Step 124 may, for example, correspond to step 68 shown in FIG. 8. Finally, the method may include step 126 of polishing. Step 126 may, for example, correspond to step 74 shown in FIG. 8.

Figure 19:
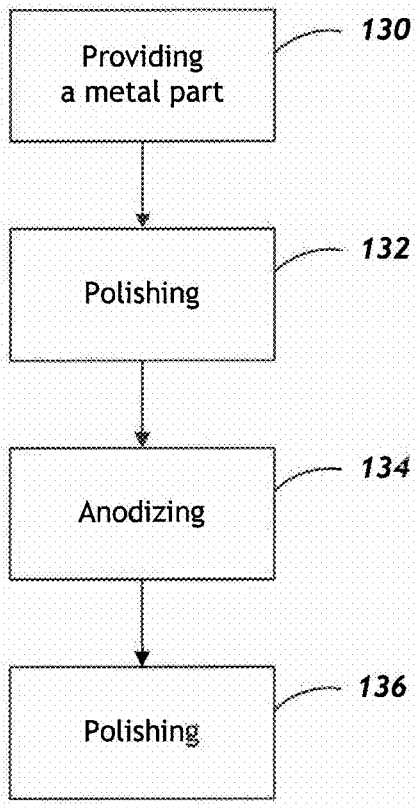
FIG. 19 is a flowchart of another exemplary method of surface treatment, in accordance with one embodiment of the present invention.

In another embodiment, as shown for example in FIG. 19, a method for treating a metal surface may include step 130 of providing a metal part. Step 130 may, for example, correspond to step 60 shown in FIG. 8. Next, the method may include step 132 of polishing. Step 132 may, for example, correspond to step 66 shown in FIG. 8. Subsequently, the method may include step 134 of anodizing. Step 134 may, for example, correspond to step 68 shown in FIG. 8. Finally, the method may include step 136 of polishing. Step 136 may, for example, correspond to step 74 shown in FIG. 8.

Figure 20:
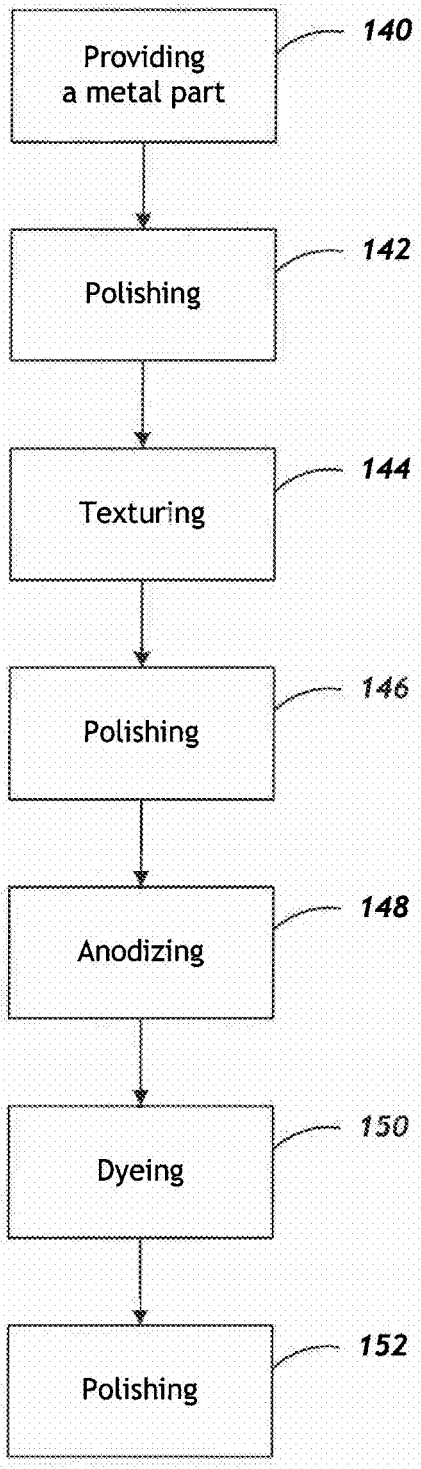
FIG. 20 is a flowchart of another exemplary method of surface treatment, in accordance with one embodiment of the present invention.

In still another embodiment, as shown for example in FIG. 20, a method for treating a metal surface may include step 140 of providing a metal part. Step 140 may, for example, correspond to step 60 shown in FIG. 8. Next, the method may include step 142 of polishing. Step 142 may, for example, correspond to step 62 shown in FIG. 8. Afterward, the method may include step 144 of texturing. Step 144 may, for example, correspond to step 64 shown in FIG. 8. Subsequently, the method may include step 146 of polishing. Step 146 may, for example, correspond to step 66 shown in FIG. 8. Then, the method may include step 148 of anodizing. Step 148 may, for example, correspond to step 68 shown in FIG. 8. Next, the method may include step 150 of dyeing. Step 150 may, for example, correspond to step 70 shown in FIG. 8. Finally, the method may include step 152 of polishing. Step 152 may, for example, correspond to step 74 shown in FIG. 8.

Figure 21:
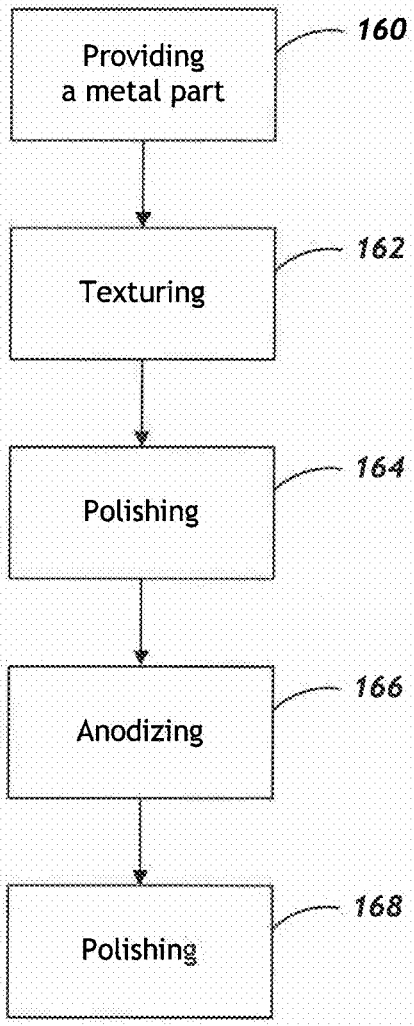
FIG. 21 is a flowchart of another exemplary method of surface treatment, in accordance with one embodiment of the present invention.

In yet another embodiment, as shown for example in FIG. 21, a method for treating a metal surface may include step 160 of providing a metal part. Step 160 may, for example, correspond to step 60 shown in FIG. 8. Next, the method may include step 162 of texturing. Step 162 may, for example, correspond to step 64 shown in FIG. 8. Subsequently, the method may include step 164 of polishing. Step 164 may, for example, correspond to step 66 shown in FIG. 8. Afterwards, the method may include step 166 of anodizing. Step 166 may, for example correspond to step 68 shown in FIG. 8. Finally, the method may include step 168 of polishing. Step 168 may, for example correspond to step 74 shown in FIG. 8.

In some embodiments, a first portion of a metal surface 80 may be treated in a different manner than a second portion of metal surface 80 in order to create different patterns and visual effects. In one embodiment, the first portion of metal surface 80 may be treated and the second portion may not be treated. In another embodiment the first portion and second portions of metal surface 80 may be treated by different techniques. The different techniques may vary the treatments described above that are included in the technique or may vary the parameters of a treatment between the techniques. For example, one technique may include standard anodization and the other technique may include hard anodization, or one technique may polish to a different surface roughness than the other technique. The different patterns or visual effects on surface 80 that are created may include, but are not limited to, stripes, dots, or the shape of a logo. In one embodiment, surface 80 includes a logo, wherein the first portion of surface 80 includes the logo and the second portion of surface 80 does not contain the logo. In other embodiments, the difference in techniques may create the appearance of a logo or label, such that a separate logo or label does not need to be applied to surface 80.

Figure 22:
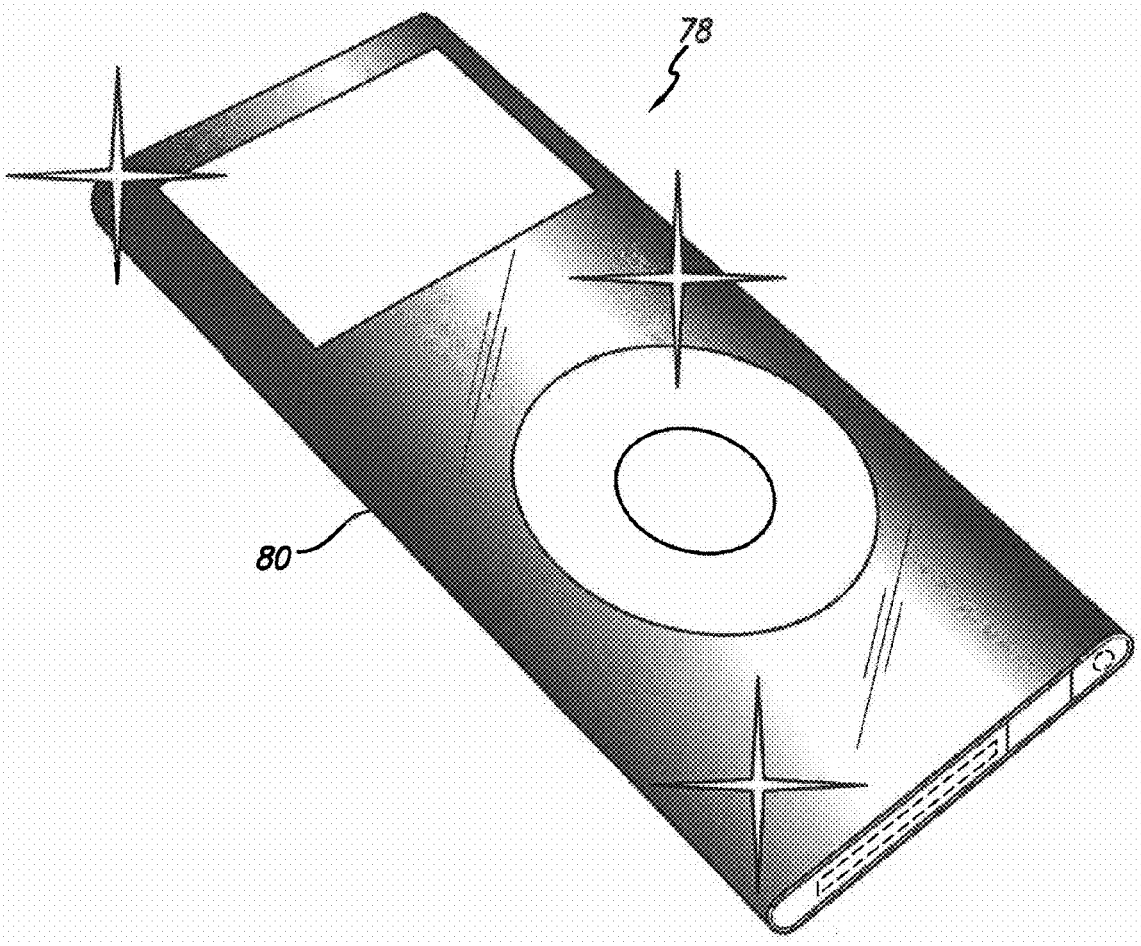
FIG. 22 is an exemplary article with a surface treated in accordance an embodiment of the present invention.

FIG. 22 illustrates an exemplary metal article 78 have a metal surface 80 treated in accordance with any of the methods described above. Article 78 is a media playing device, however this is merely an exemplary article that may be treated in accordance with the methods described above. The methods described above may be applied to a broad range of additional metal articles including, but not limited to, household appliances and cookware, such as pots and pans; automotive parts; athletic equipment, such as bikes; and electronic components, such as laptop computers and enclosures for electronic devices, such as phones and computers.

Surface 80 is an integral layer of metal article 78 having a desired cosmetic effect. The integral layer may be a coatingless layer that also has a sparkling effect, a rich color, and/or a glossy or shiny appearance. The integral layer is not a separate coating or film, but rather an integral or intrinsic part of the metal part. Accordingly, the desired cosmetic effect is achieved without the application of a separate coating or film, such as a lacquer or paint. As illustrated in FIG. 22, metal surface 80 has a sparkling effect as indicated by the stars. Metal surface 80 may also have a glossy or shiny appearance as shown by the slanted lines. In addition, metal surface 80 is shaded in regions to illustrate it has a rich color.

One characteristic of surface 80 after completion of the surface treatments that may be measured is the gloss value of surface 80 as measured at 60 degrees by a 60 degrees gloss meter. The gloss value of surface 80 may be in a range between about 100 and 390 gloss units. In some embodiments the gloss value of surface 80 may be about 100 gloss units. In some embodiments the gloss value of surface 80 may be about 110 gloss units. In some embodiments the gloss value of surface 80 may be about 120 gloss units. In some embodiments the gloss value of surface 80 may be about 130 gloss units. In some embodiments the gloss value of surface 80 may be about 140 gloss units. In some embodiments the gloss value of surface 80 may be about 150 gloss units. In some embodiments the gloss value of surface 80 may be about 160 gloss units. In some embodiments the gloss value of surface 80 may be about 170 gloss units. In some embodiments the gloss value of surface 80 may be about 180 gloss units. In some embodiments the gloss value of surface 80 may be about 190 gloss units. In some embodiments the gloss value of surface 80 may be about 200 gloss units. In some embodiments the gloss value of surface 80 may be about 210 gloss units. In some embodiments the gloss value of surface 80 may be about 220 gloss units. In some embodiments the gloss value of surface 80 may be about 230 gloss units. In some embodiments the gloss value of surface 80 may be about 240 gloss units. In some embodiments the gloss value of surface 80 may be about 250 gloss units. In some embodiments the gloss value of surface 80 may be about 260 gloss units. In some embodiments the gloss value of surface 80 may be about 270 gloss units. In some embodiments the gloss value of surface 80 may be about 280 gloss units. In some embodiments the gloss value of surface 80 may be about 290 gloss units. In some embodiments the gloss value of surface 80 may be about 300 gloss units. In some embodiments the gloss value of surface 80 may be about 310 gloss units. In some embodiments the gloss value of surface 80 may be about 320 gloss units. In some embodiments the gloss value of surface 80 may be about 330 gloss units. In some embodiments the gloss value of surface 80 may be about 340 gloss units. In some embodiments the gloss value of surface 80 may be about 350 gloss units. In some embodiments the gloss value of surface 80 may be about 360 gloss units. In some embodiments the gloss value of surface 80 may be about 370 gloss units. In some embodiments the gloss value of surface 80 may be about 380 gloss units. In some embodiments the gloss value of surface 80 may be about 390 gloss units. If a dyeing step, such as dyeing step 42, 70, or 150, is performed, the gloss value of surface 80 may be in a range between about 100 and 350 gloss units. If dyeing step, such as dyeing step 42, 70, or 150, is not performed, the gloss value of surface 80 may be in a range between about 180 and 390 gloss units. The gloss values listed above are exemplary.

The result of the surface treatments to surface 80 of metal part 78 is an oxide layer 86 that is an integral layer of metal part 78 that has a desired cosmetic effect and visual appearance. Integral layer 86 resembles a coating or layer that has been applied to the metal surface, but is actually an integral or intrinsic part of metal article 78 that has been treated to obtain the desired cosmetic effect, i.e. the integral layer is not a separate coating or film. The integral layer may be a coatingless layer that also has a sparkling effect, a rich color, and/or a glossy or shiny appearance. The integral layer is not a separate coating or film, but rather an integral or intrinsic part of the metal part. Accordingly, the desired cosmetic effect is achieved without the application of a separate coating or film, such as a lacquer or paint.

The gloss value of a treated metal part or article is affected by whether or not the metal part is dyed and the particular dye composition utilized. For example, in a process of treating a surface 80 of extruded 6063 grade aluminum, after a step of polishing, such as step 26, 66, 132, 146, or 164, surface 80 may have a gloss value measured at 20 degrees by a 20 degrees gloss meter in a range between about 130 and 280 gloss units. This gloss value range is merely exemplary. In some embodiments, a dyeing step, such as dyeing step 42, 70, or 150, is not performed and surface 80 may retain a silver color and may have a gloss value range from between about 180 and 390 gloss units when measured at 60 degrees using a 60 degrees gloss meter. In one embodiment, surface 80 may have a gloss value of about 195 when measured at 60 degrees using a 60 degrees gloss meter. The above gloss values are exemplary.

Figure 23:
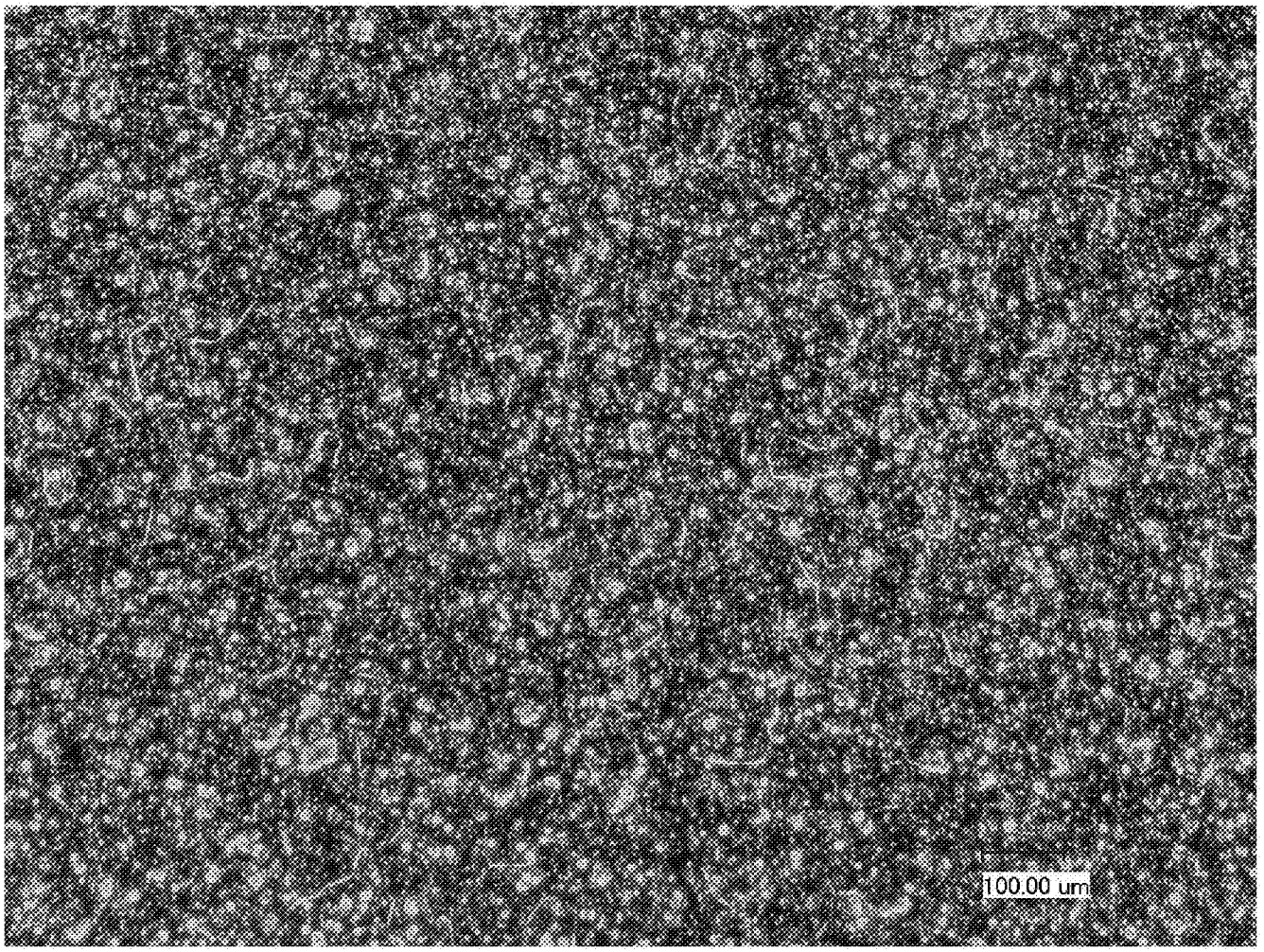
FIGS. 23 and 24 are magnified color images of a finish achieved through a surface treatment in accordance with an embodiment of the present invention.
Figure 24:
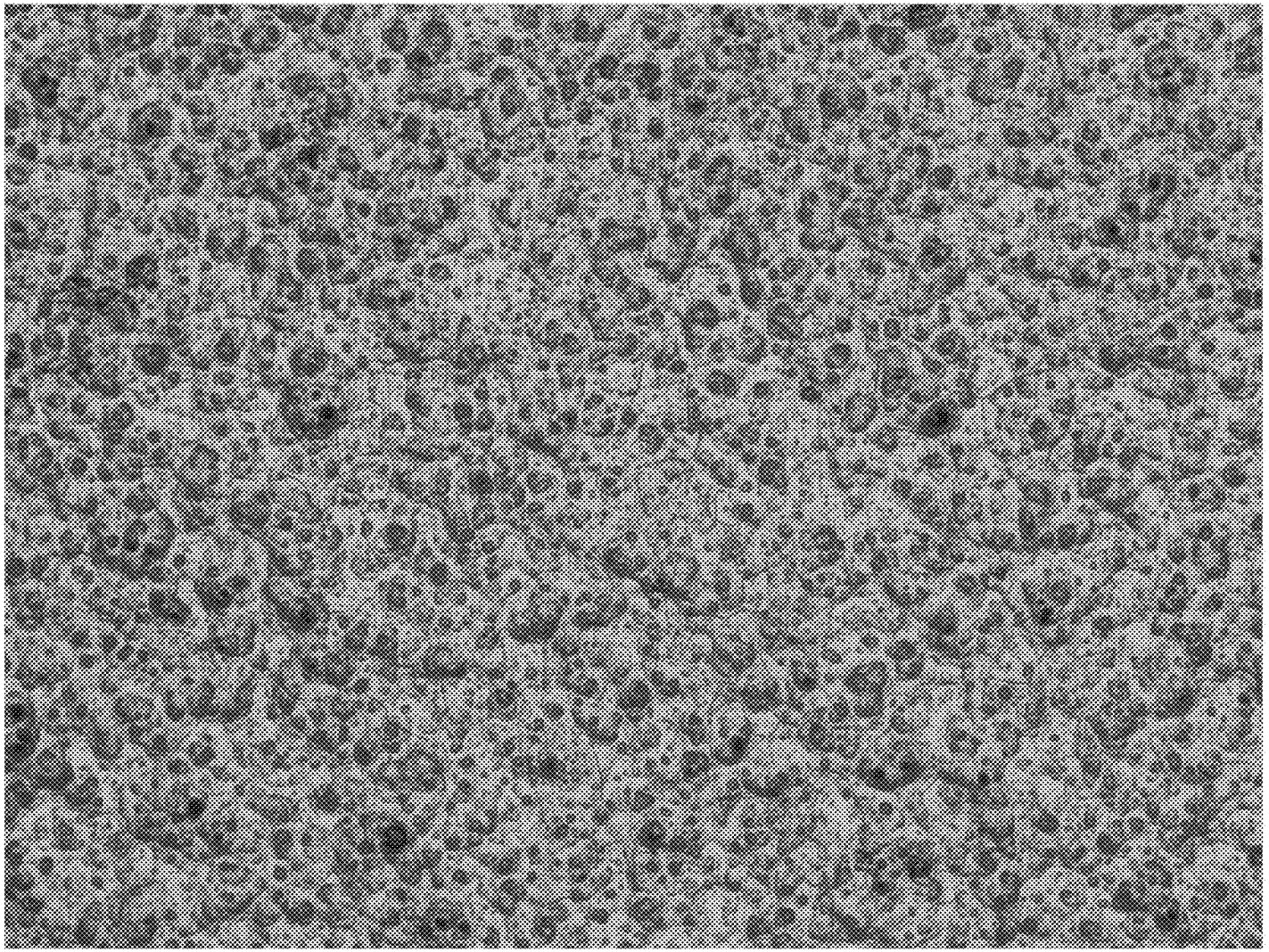

FIGS. 23 and 24 illustrate an exemplary characteristic structure of a finish on surface 80 that can be achieved through the above described techniques. The images depicted in FIGS. 23 and 24 were generated with an optical microscope at 200 times magnification, and each was generated using a different filter.

Figure 25:
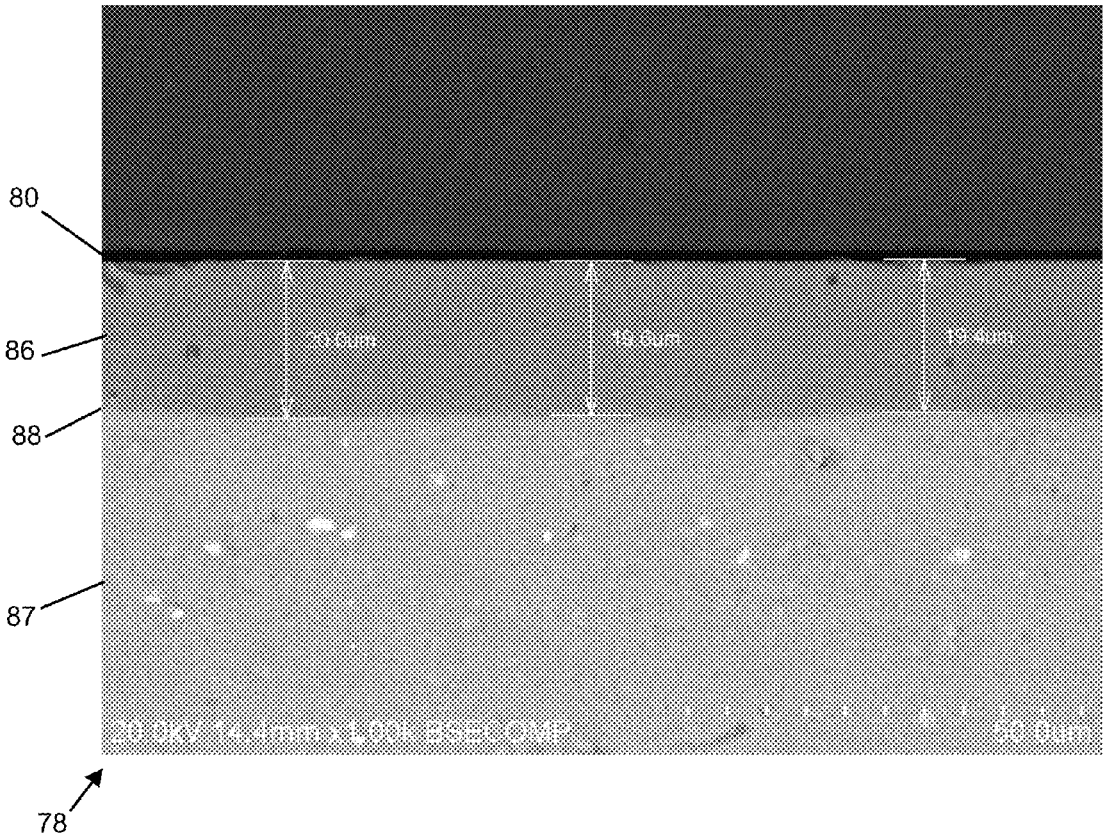
FIGS. 25-31 are magnified sectional views of a finish achieved through a surface treatment in accordance with an embodiment of the present invention.
Figure 26:
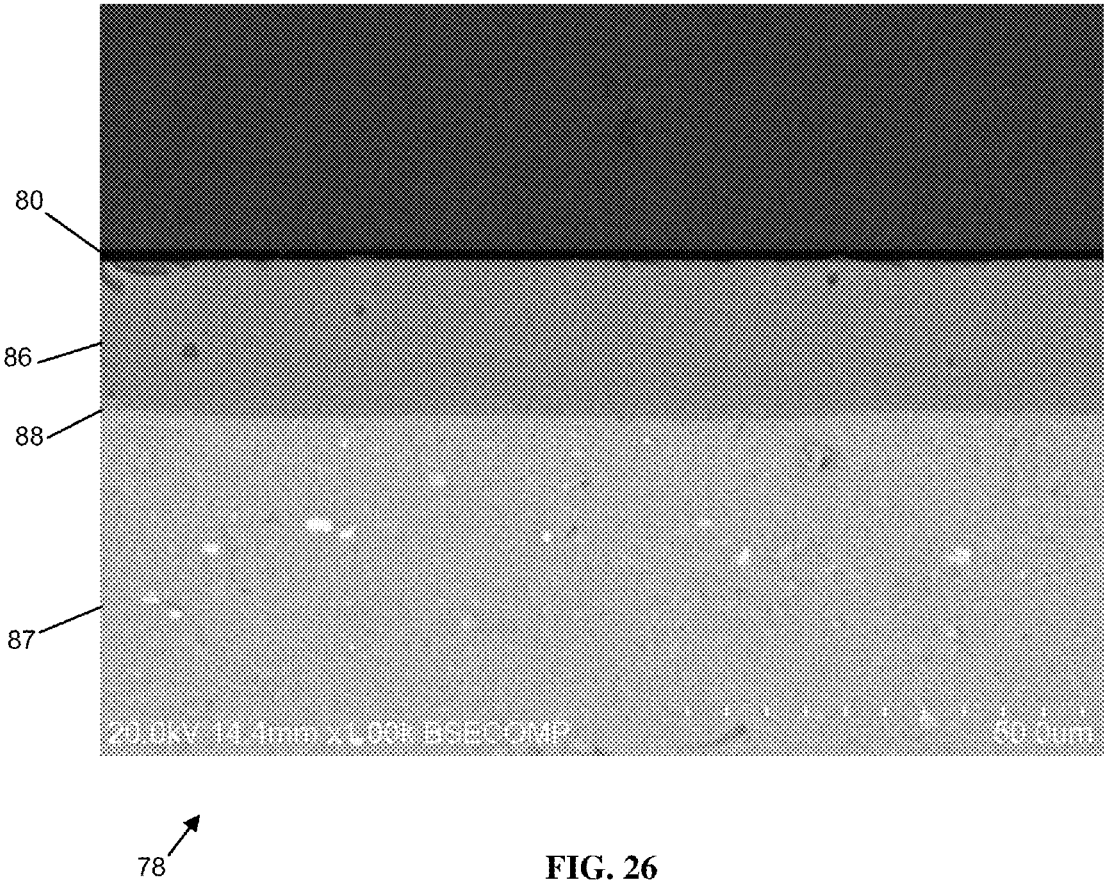
Figure 27:
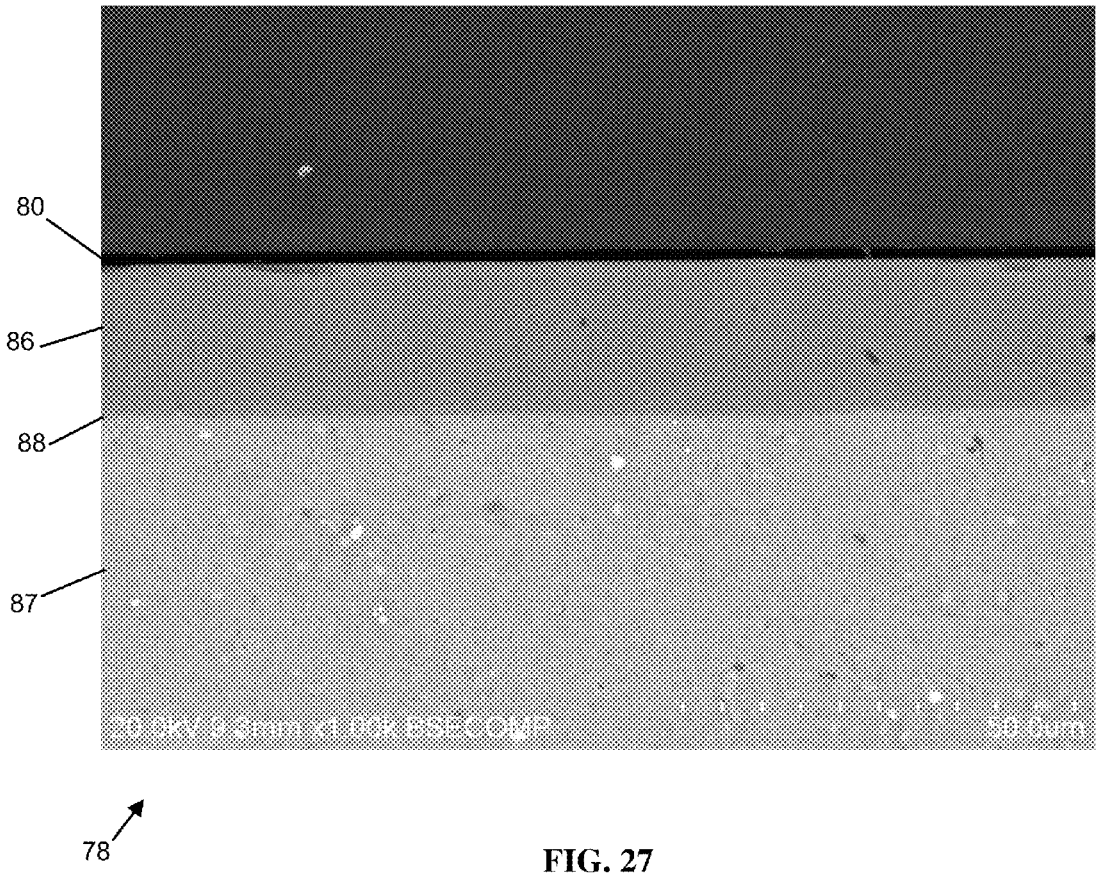
Figure 28:
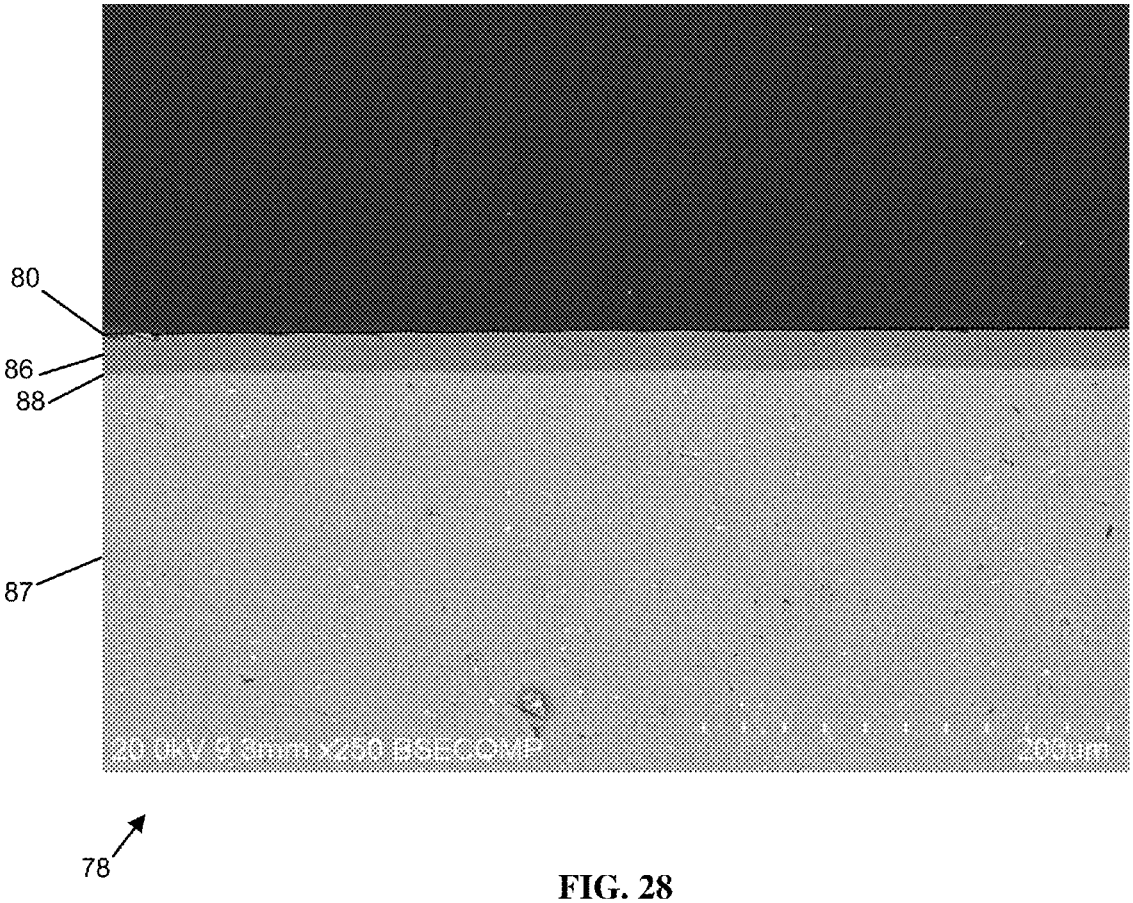
Figure 29:
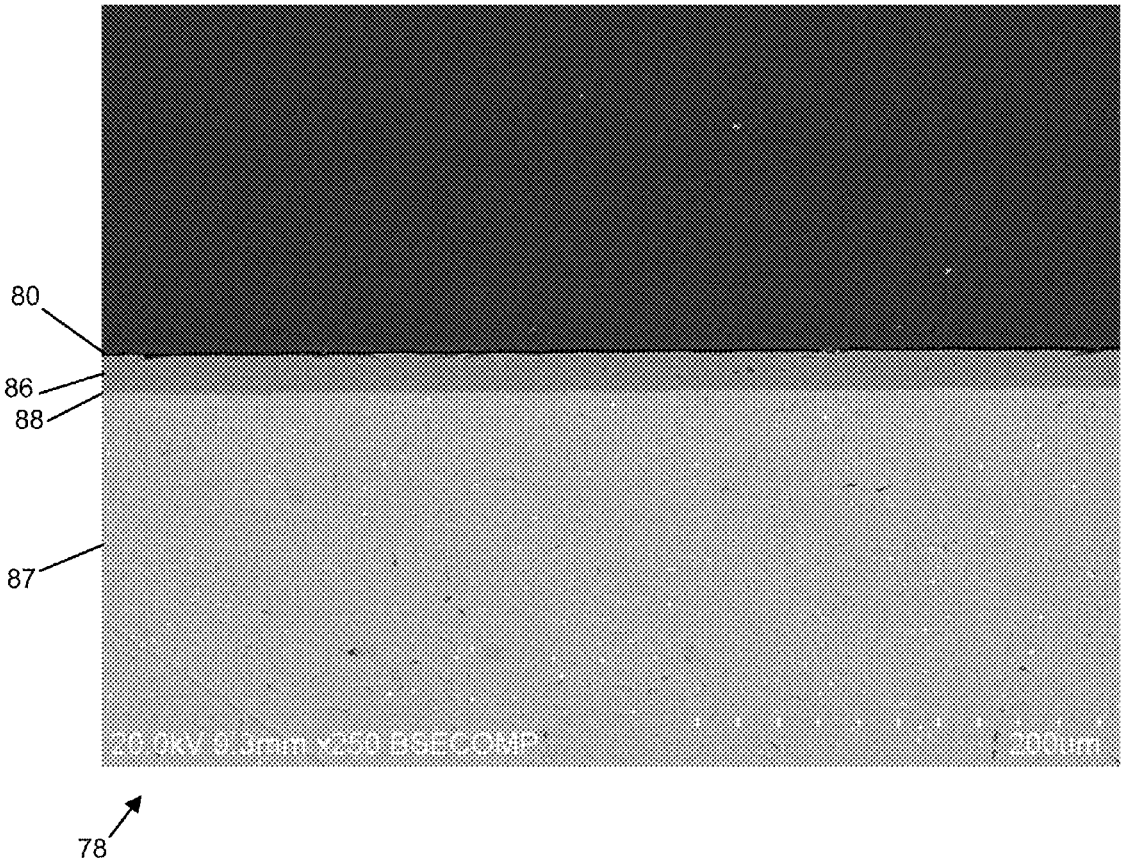
Figure 30:
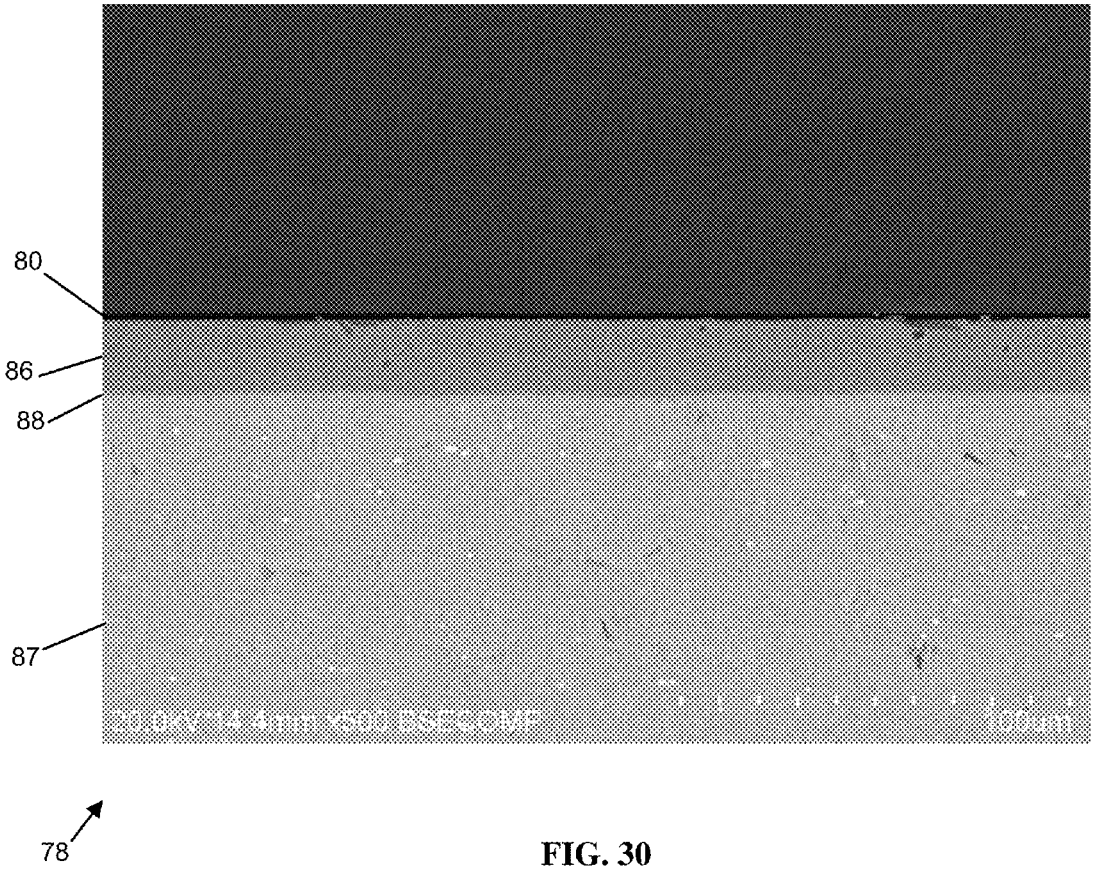
Figure 31:
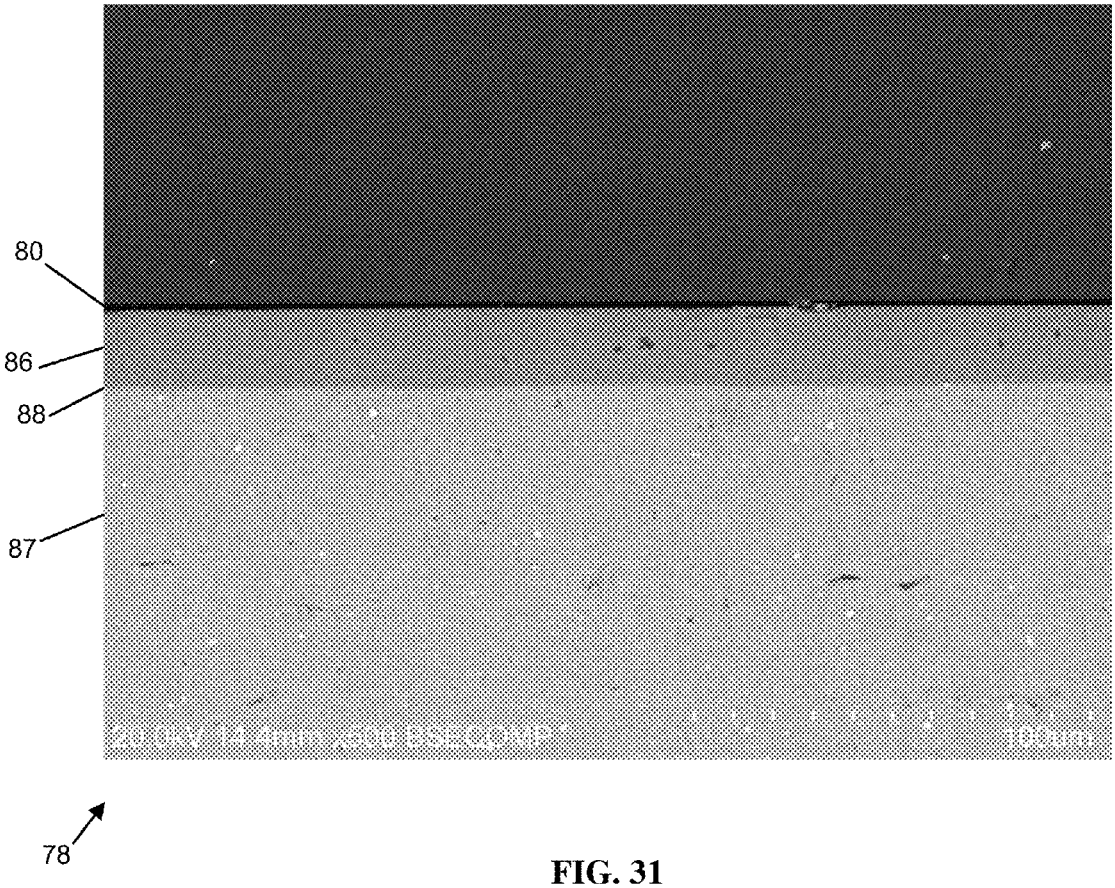

FIGS. 25 through 31 illustrate exemplary sectional views of a finish on surface 80 that can be achieved through the above described techniques. The images depicted in FIGS. 25 through 31 were generated using a scanning electron microscope. FIGS. 25, 26, and 27 were generated at 1000 times magnification. FIGS. 28 and 29 were generated at 250 times magnification. FIGS. 30 and 31 were generated at 500 times magnification.

In some embodiments a dyeing step, such as dyeing step 42, 70, or 150, is performed and a variety of colors may be achieved depending upon the particular dye composition, dye concentration, and/or duration of dyeing.

In some embodiments, surface 80 may be dyed to have a dark gray color. The dark gray color may be achieved by using a dye composition comprising a mixture of black dye, blue dye, and red dye. Surface 80 may have a gloss value range from between about 110 and 240 gloss units when measured at 60 degrees using a 60 degrees gloss meter. In one embodiment, surface 80 may have a gloss value of about 120 when measured at 60 degrees using a 60 degrees gloss meter. The above gloss values are exemplary.

In some embodiments, surface 80 may be dyed to have a green color. The green color may be achieved by using a dye composition comprising a mixture of yellow dye and blue dye. Surface 80 may have a gloss value range from between about 115 and 250 gloss units when measured at 60 degrees using a 60 degrees gloss meter. In one embodiment, surface 80 may have a gloss value of about 125 when measured at 60 degrees using a 60 degrees gloss meter. The above gloss values are exemplary.

In some embodiments, surface 80 may be dyed to have a red color. The red color may be achieved by using a dye composition comprising a mixture of red dye, pink dye, and black dye. Surface 80 may have a gloss value range from between about 106 and 230 gloss units when measured at 60 degrees using a 60 degrees gloss meter. In one embodiment, surface 80 may have a gloss value of about 115 when measured at 60 degrees using a 60 degrees gloss meter. The above gloss values are exemplary.

In some embodiments, surface 80 may be dyed to have a purple color. The purple color may be achieved by using a dye composition comprising a mixture of blue dye and violet dye. Surface 80 may have a gloss value range from between about 102 and 220 gloss units when measured at 60 degrees using a 60 degrees gloss meter. In one embodiment, surface 80 may have a gloss value of about 110 when measured at 60 degrees using a 60 degrees gloss meter. The above gloss values are exemplary.

In some embodiments, surface 80 may be dyed to have a blue color. The blue color may be achieved by using a dye composition comprising a mixture of blue dye and violet dye. Surface 80 may have a gloss value range from between about 110 and 240 gloss units when measured at 60 degrees using a 60 degrees gloss meter. In one embodiment, surface 80 may have a gloss value of about 120 when measured at 60 degrees using a 60 degrees gloss meter. The above gloss values are exemplary.

In some embodiments, surface 80 may be dyed to have a pink color. The pink color may be achieved by using a dye composition comprising a mixture of pink dye and red dye. Surface 80 may have a gloss value range from between about 120 and 260 gloss units when measured at 60 degrees using a 60 degrees gloss meter. In one embodiment, surface 80 may have a gloss value of about 130 when measured at 60 degrees using a 60 degrees gloss meter. The above gloss values are exemplary.

In some embodiments, surface 80 may be dyed to have an orange color. The orange color may be achieved by using a dye composition comprising a mixture of orange dye and red dye. Surface 80 may have a gloss value range from between about 133 and 290 gloss units when measured at 60 degrees using a 60 degrees gloss meter. In one embodiment, surface 80 may have a gloss value of about 145 when measured at 60 degrees using a 60 degrees gloss meter. The above gloss values are exemplary.

In some embodiments, surface 80 may be dyed to have a yellow color. The yellow color may be achieved by using a dye composition comprising a mixture of yellow dyes. Surface 80 may have a gloss value range from between about 161 and 350 gloss units when measured at 60 degrees using a 60 degrees gloss meter. In one embodiment, surface 80 may have a gloss value of about 175 when measured at 60 degrees using a 60 degrees gloss meter. The above gloss values are exemplary.

In some embodiments, surface 80 may be dyed to have a gold color. The gold color may be achieved by using a dye composition comprising a mixture of orange dye and black dye. Surface 80 may have a gloss value range from between about 157 and 340 gloss units when measured at 60 degrees using a 60 degrees gloss meter. In one embodiment, surface 80 may have a gloss value of about 170 when measured at 60 degrees using a 60 degrees gloss meter. The above gloss values are exemplary.

A variety of colors for surface 80 may be achieved by varying the dye composition, the concentration of the dye and the duration of dyeing based on visualization and/or experimentation.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

In addition, the breadth and scope of the present invention should not be limited by any of the above-described exemplary embodiments, but should be defined only in accordance with the following claims and their equivalents.

What is claimed is:

1. A method of treating a metal surface comprising:

forming a uniformly flat metal surface by polishing the metal surface until the metal surface has a surface roughness of about 0.1 micrometers or less;

forming a textured metal surface by texturing and then polishing the uniformly flat metal surface such that the textured metal surface has a plurality of substantially isolated and rounded peaks separated by a plurality of valleys, wherein the texturing and polishing of the uniformly flat metal surface is performed to achieve a desired sparkling effect and glossy appearance, wherein a level of glossy appearance is associated with a proportion of rounding of the plurality of peaks and a level of sparkling effect is associated with a proportion of valleys on the textured metal surface;

anodizing the textured metal surface to form an oxide layer on the textured metal surface, the oxide layer being an integral part of the textured metal surface;

imparting a color to the oxide layer by depositing a dye composition within the oxide layer; and creating a finished surface by polishing the oxide layer until the oxide layer attains a desired finish, wherein the desired sparkling effect and glossy appearance imparted to the textured metal surface is visible through the polished oxide layer, wherein the desired sparkling effect and glossy appearance of the textured metal surface, the color of the oxide layer, and the desired finish of the oxide layer combine to provide a gloss value of the finished surface within a predetermined gloss value range.

2. The method of claim 1, wherein a transition line is formed between the textured metal surface and the oxide layer and an average distance between the transition line and a top surface of the oxide layer is between about 12 and 20 micrometers.

3. The method of claim 1, wherein the finished surface has a gloss value in a range between about 110 and 390 gloss units measured with a 60 degrees gloss meter.

4. The method of claim 1, wherein the metal surface is polished until the metal surface has a surface roughness of about 0.075 micrometers or less.

5. The method of claim 4, wherein the metal surface is polished until the metal surface has a surface roughness of about 0.05 micrometers or less.

6. The method of claim 1, wherein imparting the color to the oxide layer comprises:

depositing a plurality of dye particles into pores of the oxide layer.

7. The method of claim 6, further comprising:

applying a sealant to seal the pores of the oxide layer.

8. The method of claim 1, wherein polishing the oxide layer comprises polishing a top surface of the oxide layer using a buffing wheel.

9. The method of claim 1, wherein polishing the oxide layer comprises polishing a top surface of the oxide layer using a tumbling procedure.

10. The method of claim 1, wherein polishing the oxide layer comprises:

tumbling a metal part having the oxide layer; and buffing the metal part after tumbling.

11. The method of claim 1, wherein polishing the oxide layer comprises:

coarsely buffing a top surface using a first buffing wheel having a first abrasiveness; and finely buffing a top surface using a second buffing wheel having a second abrasiveness.

12. The method of claim 1, wherein the dye composition includes a mixture of yellow dye and blue dye resulting in the oxide layer having a green appearance, wherein the gloss value ranges from about 115 and 250 gloss units as measured by a 60 degree gloss meter.

13. The method of claim 1, wherein the dye composition includes a mixture of black dye, blue dye, and red dye resulting in the oxide layer having a gray appearance, wherein the gloss value ranges from about 110 and 240 gloss units as measured by a 60 degree gloss meter.

14. The method of claim 1, wherein the dye composition includes a mixture of red dye, pink dye, and black dye resulting in the oxide layer having a red appearance, wherein the gloss value ranges from about 106 and 230 gloss units as measured by a 60 degree gloss meter.

15. The method of claim 1, wherein the dye composition includes a mixture of blue dye and violet dye resulting in the oxide layer having a purple appearance, wherein the gloss value ranges from about 102 and 220 gloss units as measured by a 60 degree gloss meter.

16. The method of claim 1, wherein the dye composition includes a mixture of blue dye and violet dye resulting in the oxide layer having a blue appearance, wherein the gloss value ranges from about 110 and 240 gloss units as measured by a 60 degree gloss meter.

17. The method of claim 1, wherein the dye composition includes a mixture of pink dye and red dye resulting in the oxide layer having a pink appearance, wherein the gloss value ranges from about 120 and 260 gloss units as measured by a 60 degree gloss meter.

18. The method of claim 1, wherein the dye composition includes a mixture of orange dye and red dye resulting in the oxide layer having an orange appearance, wherein the gloss value ranges from about 133 and 290 gloss units as measured by a 60 degree gloss meter.

19. The method of claim 1, wherein the dye composition includes a mixture of yellow dyes resulting in the oxide layer having a yellow appearance, wherein the gloss value ranges from about 161 and 350 gloss units as measured by a 60 degree gloss meter.

20. The method of claim 1, wherein the dye composition includes a mixture of orange dye and black dye resulting in the oxide layer having a gold appearance, wherein the gloss value ranges from about 157 and 340 gloss units as measured by a 60 degree gloss meter.

21. The method of claim 1, further comprising choosing a dye composition such that the gloss value of the finished surface is within the predetermined gloss value range.

* * * * *